US005224520A

United States Patent [19]

Shinbara et al.

[11] Patent Number: 5,224,520

[45] Date of Patent: Jul. 6, 1993

[54] WEAVING BAR PREVENTION IN A JET LOOM

[75] Inventors: Masami Shinbara; Fumio Yasuoka, both of Kariya, Japan

[73] Assignee: Kabushiki Kaisha Toyoda Jidoshokki Seisakusho, Kariya, Japan

[21] Appl. No.: 790,573

[22] Filed: Nov. 8, 1991

[30] Foreign Application Priority Data

| | | | |
|---|---|---|---|
| Nov. 19, 1990 | [JP] | Japan | 2-314712 |
| Dec. 14, 1990 | [JP] | Japan | 2-402520 |
| Jun. 7, 1991 | [JP] | Japan | 3-136677 |
| Aug. 29, 1991 | [JP] | Japan | 3-219035 |

[51] Int. Cl.[5] ..... D03D 49/04; D03D 47/34

[52] U.S. Cl. ..... 139/116.2; 139/110

[58] Field of Search ..... 139/116.2, 435.5, 435.1, 139/336, 1 R, 110

[56] References Cited

U.S. PATENT DOCUMENTS

| | | | |
|---|---|---|---|
| 4,564,050 | 1/1986 | Hirano | 139/110 |
| 4,750,527 | 6/1988 | Rehling | 139/110 |
| 4,989,644 | 2/1991 | Tanaka et al. | 139/116.2 |
| 5,090,452 | 2/1992 | Benelli | 139/116.2 X |

*Primary Examiner*—Andrew M. Falik

*Attorney, Agent, or Firm*—Brooks Haidt Haffner & Delahunty

[57] ABSTRACT

Upon slow operation of a loom, a feed-out motor for a warp beam or a wind-up motor for a surface roller is driven to thereby displace a cloth fell of woven fabric from a normal position toward the fabric, and upon completion of the slow operation, the motor is driven reversely to allow the cloth fell to ressume the normal position. The cloth fell is thereby prevented from being beaten by a reed while protecting woven fabric from generation of weaving bar. Suppression of the weaving bar can also be realized by varying warp tension or a one-shot weft insertion performed from a main weft inserting nozzle while causing auxiliary nozzles to previously produce jets simultaneously or in relays.

27 Claims, 24 Drawing Sheets

WEAVING BAR PREVENTION IN A JET LOOM

BACKGROUND OF THE INVENTION

1. Field of the Invention

The present invention generally relates to a one-shot weft insertion in a jet loom and more particularly, to a method and apparatus for preventing occurrence or generation of a weaving bar (also known as weft bar, filling bar or simply as barré) which may occur due to a low-speed or slow reverse revolution or slow forward revolution of a loom performed during the stoppage of the weaving operation.

2. Description of the Prior Art

For restarting operation of a loom which has been stopped manually or suspended automatically due to occurrence of warp breakage, there is observed a tendency that a thin weaving bar (thin place) is formed in a woven fabric or cloth because of insufficient reed beating force although it depends on the starting characteristic of the loom. Further, when loom operation is stopped due to occurrence of failure in insertion of a weft and is to be restarted after removal of the failure suffering weft, the loom, by revolving at a low speed or slowly in the reverse direction (i.e. reversely or backwardly relative to the direction of weaving), causes fabric just woven and located in the vicinity of the cloth fell to become loosened or slackened and to move rearwardly of the loom from the original or normal position to thereby generate a thick weaving bar (thick place).

For coping with such generation of the weaving bars, there have already been proposed measures or mechanisms for increasing the loom starting torque or correcting the position of the cloth fell prior to the start or restart of the loom, as disclosed, for example, in JP-A-60-231849 (Japanese Patent Application Laid-Open No. 231849/1985), JP-A-61-55241, JP-A-62-263352, Japanese Utility Model Publication No. 94988/1988 and others.

As one type of weaving bar, there is known a so-called "wavy set marks". More specifically, when a cloth fell of a woven fabric is beaten by a reed during the slow reverse or forward revolution of the loom occuring while the weaving operation is suspended, the warps on the cloth fell are displaced in the direction thicknesswise (i.e. upwardly or downwardly) of the woven fabric, as a result of which the corresponding woven portion protrudes from the fabric in a pillow-like configuration. This is herein referred to as the "wavy set mark". Such wavy set mark is likely to be formed in the case of a twill fabric. Of course, in other fabric than the twill, a weaving bar may be formed due to an increase in the weft density in the cloth fell as brought about by the beating during the slow motion of the loom. However, because the weaving bar is generated due to the slow revolution of the loom crankshaft occurring during suspension of the weaving operation, it is impossible to prevent occurrence of the wavy set mark with the weaving bar suppressing means known heretofore as mentioned above which are destined to prevent the weaving bar from occurring when the normal loom motion is restarted.

SUMMARY OF THE INVENTION

It is therefore a general object of the present invention to provide a method and apparatus which are capable of preventing occurrence or generation of a weaving bar due to a slow loom revolution while the weaving operation is suspended.

With the above object in view, it is proposed according to an aspect of the present invention that upon slow forward or reverse revolution of a loom, cloth-fell position displacing means is driven to displace the cloth fell by a predetermined amount or distance from a normal position toward the woven fabric, and the cloth fell is caused to resume the normal position by driving the cloth fell position displacing means after the completion of the slow forward or reverse revolution of the loom. As is known, the reed is also caused to swing accompanying the slow forward or reverse revolution of the loom. Accordingly, when the cloth fell is located at the normal position, it will be beaten by the reed. However, by offsetting or displacing the cloth fell from the normal position toward the woven cloth, the cloth fell can be placed outside of a region which undergoes the beating action, whereby the cloth fell is protected against beating by the reed. As a result, generation of the wavy set mark or other types of weaving bars can be prevented.

Furthermore, it is another object of the present invention to provide a one-shot weft inserting method and apparatus which are capable of preventing more positively the occurrence of weaving bars in a jet loom in which weft insertion failure is more likely to take place when compared with other types of looms.

According to another aspect of the present invention, there is provided a weaving bar generation preventing apparatus for a loom which comprises means for changing the warp tension, warp tension setting means for setting the warp tension for the slow revolution of the loom occurring during suspension of the weaving operation by taking into account the tendency of generation of a weaving bar due to the slow loom revolution occurring while the weaving operation is suspended, and warp tension change control means for controlling the warp tension changing means such that the warp tension set by the warp tension setting means becomes effective during the slow loom revolution occuring during the suspension of the weaving operation. In the slow loom revolution, the warp tension changing means first controls the warp tension setting means so that the warp tension is changed. to the tension set by the warp tension setting means. In this conjunction, the tension may be set high when there is a tendency of generation of a thick weaving bar, while the tension may be set low for a tendency of occurrence of thin a weaving bar, by way of example. Owing to the change or control of the warp tension, the reed beating force or effort during the slow loom revolution is so adjusted that occurrence of a weaving bar can be prevented.

According to another aspect of the present invention, it is taught that auxiliary weft inserting nozzles are so controlled as to first produce or eject air jets, and subsequently one weft is ejected from a main weft inserting nozzle for insertion prior to the start of the weaving operation. For removing the weft inserted immediately before stoppage of the weaving operation from the cloth fell, it is required to perform a slow reverse revolution of the loom to thereby form an inter-warp opening to a maximum extent for thereby allowing the weft of concern to be released from the woven state. During this loom operation, the cloth fell is beaten by the reed, whereby the weft on the cloth fell is caused to displace in the direction thicknesswise of the woven fabric. Accordingly, the weft displaced upwardly and downwardly is removed, which is then followed by insertion of one fresh weft to replace the removed weft. Thereafter, the reed is moved to the position suited for restarting the weaving operation. In that case, the fresh weft may be ejected from the main weft inserting nozzle while the auxiliary nozzles are ejecting the air jets. Alternatively, in the case of a loom of the type in which a fluid or breeze path for preventing weft from missing is fluidly associated with the main weft inserting nozzle separately from the ordinary weft inserting fluid path, the weft to replace the failed and removed weft may be inserted along the weft missing preventing path, so that the weft can be carried by a fluid or air flowing along the weft missing preventing path.

Unless the fresh weft is inserted for replacing the removed weft, it is necessary to effect a slow reverse loom revolution at least one rotation in order to cause the reed to move to the position suited for restarting the weaving. Due to this slow reverse loom revolution, a wavy set mark will be produced as a result of beating of the cloth fell by the reed. However, by inserting one fresh weft in place of the removed weft, it is possible to prevent the reed from following the route via the cloth fell in the course of moving to the position suited for restarting the weaving, whereby occurrence of the wavy set mark can be prevented.

DETAILED DESCRIPTION OF THE PREFERRED EMBODIMENTS

Now, the present invention will be described in detail in conjunction with preferred embodiments thereof by reference to the drawings, in which like reference symbols denote like or equivalent parts throughout various figures.

Figure 1:
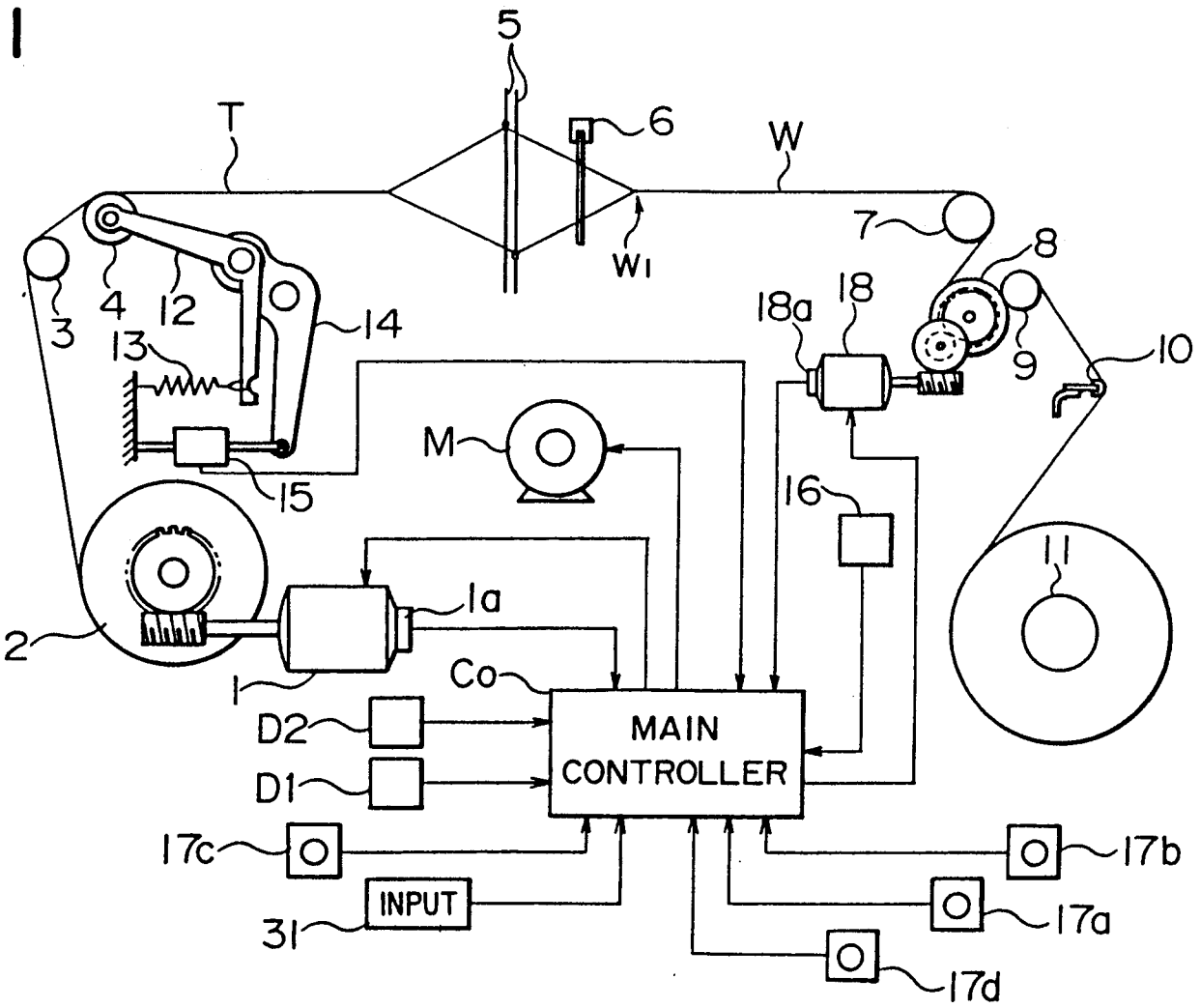
FIG. 1 is a schematic side elevational view generally showing a weaving machine or loom incorporating an apparatus for preventing generation of a weaving bar in a fabric according to a first embodiment of the present invention.

FIG. 1 is a side elevational view schematically showing a general arrangement of a loom or weaving machine to which the present invention is applied. In FIG. 1, a reference character M denotes a loom motor of which operation is under the control of a main control computer $C_0$. A reference numeral 1 denotes a reversible feed-out motor which is provided independent of the loom motor M for driving a warp beam 2. Warps T fed out from the warp beam 2 are threaded through a heald 5 and a modified reed 6 by way of a back-up roller 3 and a tension roller 4. A woven fabric or cloth W is wound up around a cloth roller 11 through an expansion bar 7, a surface roller 8, a press roller 9 and a crease removing guide member 10.

The tension roller 4 is mounted on a tension lever 12 at one end thereof, wherein tension of a predetermined magnitude is applied to the warps T by a tension spring 13 which is secured to the tension lever 12 at the other end thereof. The tension lever 12 is rotatably supported by a detection lever 14 at one end thereof. A load cell 15 is operatively connected to the other end of the detection lever 14. The tension of the warp T is transmitted to the load cell 15 through the tension roller 4, the tension lever 12 and the detection lever 14. The load cell 15 produces an electric signal corresponding to the warp tension as transmitted thereto. The output signal from the load cell 15 is inputted to the main control computer $C_0$.

The main control computer $C_0$ compares the detected tension represented by the input signal supplied from the load cell 15 with a preset tension and controls the rotation speed of the feed-out motor 1 on the basis of the diameter of the warp beam represented by a detection signal which is supplied from a rotary encoder 16 adapted to detect the angle of rotation of the crankshaft of the weaving machine or loom. In this manner, the tension of the warp is controlled during normal operation of the loom to prevent a weaving bar from occurring in the fabric or cloth being woven.

The main control computer $C_0$ responds to an ON signal produced by a start switch 17*a* to thereby command forward operation or rotation of the feed-out motor 1 and at the same time controls the rotation speed of the feed-out motor 1 in accordance with a rotation speed detecting signal supplied from a rotary encoder 1*a* incorporated in the feed-out motor 1 through a feed-back control loop.

The surface roller 8 is operatively connected to a reversible wind-up motor 18 provided separately from the loom motor M. The main control computer $C_0$ performs a feed-back control of the rotation speed of the wind-up motor 18 in accordance with a rotation speed detection signal supplied from a rotary encoder 18*a* provided in association with the wind-up motor 18.

Figure 2:
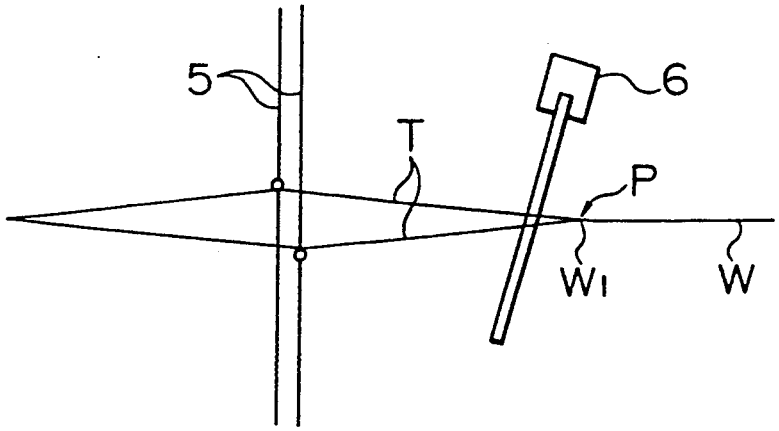
FIG. 2 is a schematic side elevational view showing a main portion of the loom shown in FIG. 1 when weaving operation is suspended or stopped.

Connected to the main control computer $C_0$ is an input unit 31 provided for controlling positional displacement of a cloth fell $W_1$ and for other purposes. More specifically, a cloth fell displacement control is performed by the main control computer $C_0$ on the basis of displacement control data inputted through the input unit 31. Further, the main control computer $C_0$ responds to abnormality detection signals outputted from a weft insertion failure detector D1 and a warp breakage detector D2 or an ON signal produced by a stop switch 17*b* to command stoppage of the operations of the loom motor M, the feed-out motor 1 and the wind-up motor 18, whereby the motors M, 1 and 18 are caused to stop in synchronism with one another, as indicated by curves $D_1$, $D_2$ and $D_3$ shown in FIG. 5. As a result, the warp feeding operation as well as the cloth winding operation are interrupted while the reed 6 is caused to stop at a position immediately before the beating position, as shown in FIG. 2.

Figure 3:
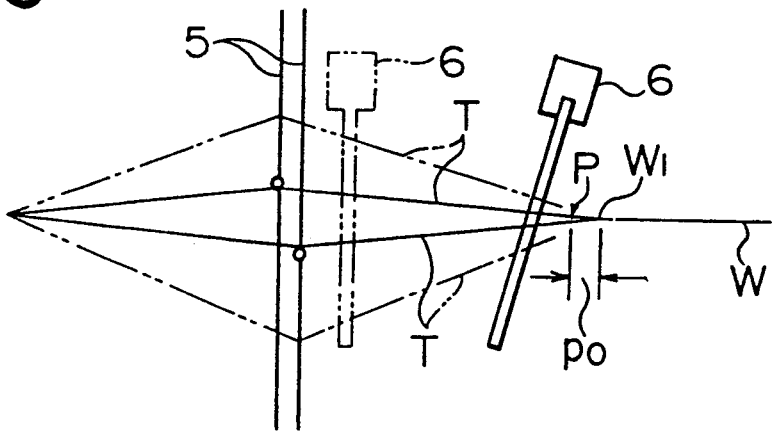
FIG. 3 is a schematic side view showing the main portions of the loom in which a cloth fell is retracted from a reed-beaten position toward the woven fabric.
Figure 4:
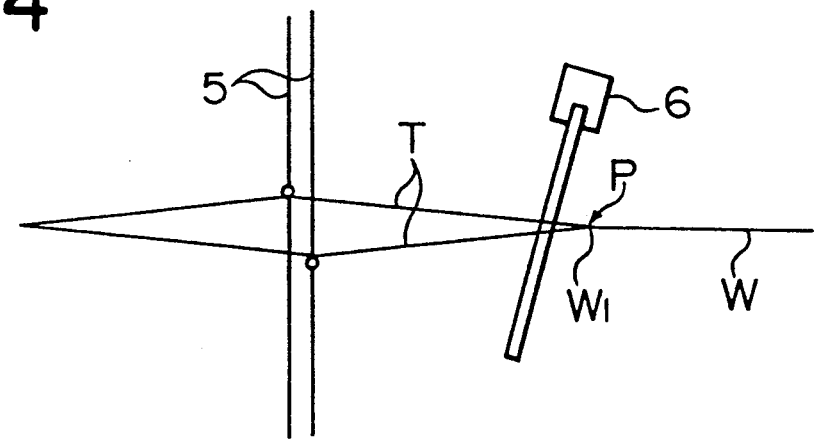
FIG. 4 is a view similar to FIG. 3, but shows the state in which the cloth fell has been restored to the normal position thereof.
Figure 5:
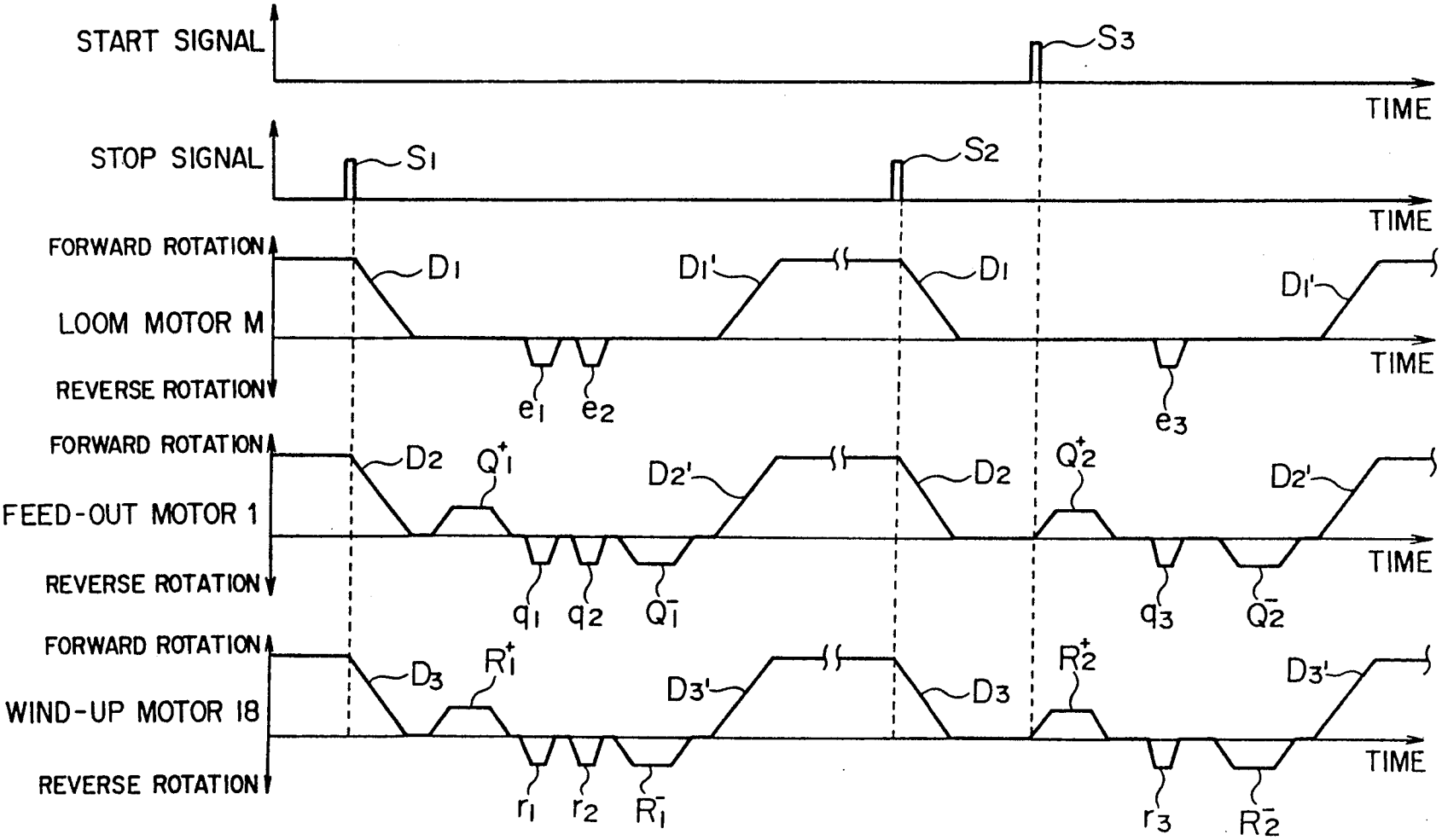
FIGS. 5 to 7 are views for graphically illustrating a cloth fell position displacing control carried out by the weaving bar generation preventing apparatus shown in FIG. 1.

In case a weaving operation stop signal $S_1$ shown in FIG. 5 originates in the weft insertion failure detector D1, the main control computer $C_0$ responds to the signal $S_1$ by issuing a command for the motor 1 to effect a low-speed or slow forward rotation by a predetermined amount $Q_1+$ inputted through the input unit 31, and at the same time the computer $C_0$ commands the wind-up motor 18 to effect a slow forward rotation by a predetermined amount $R_1+$ inputted through the input unit 31. In other words, when the weaving operation stop signal $S_1$ related to the weft insertion failure is inputted, slow forward rotation of the feed-out motor 1 by the predetermined amount $Q_1+$ and slow forward rotation of the wind-up motor 18 by the predetermined amount $R_1+$ are commanded prior to a slow (low-speed) backward or reverse rotation of the loom motor M by a predetermined amount for disposing of the weft insertion failure. As a result of this, the warp T is fed out at a low speed by a predetermined amount or length $\rho_0$ with the cloth W being wound up by the corresponding length $\rho_0$. As a result of the slow feeding operation and the slow winding operation, the cloth fell $W_1$ is caused to move in the cloth W uptake direction from the normal position P by the predetermined amount or distance $\rho_0$, as can be seen in FIG. 3.

Upon occurrence of a weft insertion failure, a weft insertion failure eliminating processing is carried out by a weft processing apparatus such as disclosed, for example, in Japanese Laid-Open Patent Application No. 61138/1991 (JP-A-H2-61138). The weft insertion failure eliminating procedure is performed under the condition that the weft of concern (i.e. failure suffering weft) beaten onto the cloth fell $W_1$ is released from the gripping action of the warps T. To this end, the loom is driven in the reverse (backward) direction about one and a half rotation at a low speed. Through this slow reverse revolution of the loom, the reed 6 is caused to pass through the normal position P, i.e. the beating position located before the cloth fell $W_1$.

After the slow forward rotations of the feed-out motor 1 and the wind-up motor 18, the loom motor M is rotated at a low speed in the reverse direction about one and a half revolution, as indicated by a curve $e_1$ in FIG. 5, whereby the loom is caused to rotate in the backward or reverse direction to a position $\theta_1$ where a maximum opening is formed between the upper and lower layers of the warps T. Further, the reed 6 is moved to the most retracted position, as indicated by broken lines in FIG. 3, resulting in that the warp layers form therebetween a maximum opening. Thus, the weft suffering the insertion failure which is located at the cloth fell $W_1$ is released from the gripping action exerted by the warps T, making it possible to carry out the weft insertion failure remedying processing.

In synchronism with the slow reverse rotation of the loom motor M, the feed-out motor 1 and the wind-up motor 18 are rotated at a low speed in the reverse direction, as indicated by curves $q_1$ and $r_1$, respectively. Consequently, the warps T are withdrawn slowly (i.e. at a low speed) by an amount proportional to the low-speed revolution of the loom, whereby the cloth W is unwound backwardly by an amount proportional to the slow reverse revolution of the loom. As a result of the withdrawal of the warps T and the unwinding of the cloth W performed in synchronism with each other, the cloth fell $W_1$ undergoes a positional displacement of magnitude which corresponds to the slow reverse revolution of the loom.

When the reed 6 moves from the stopped position shown in FIG. 2 to the position indicated by the broken lines in FIG. 3 during the slow reverse revolution of the loom, it passes through the normal cloth fell position P, i.e. the beating position. Consequently, if the cloth fell $W_1$ is located at the beating position P, the cloth fell $W_1$ will be beaten by the reed 6. However, since the cloth fell $W_1$ has been retracted from the beating position P in the uptake direction of the woven fabric or cloth W prior to the slow reverse revolution of the loom for effectuating the weft insertion failure eliminating processing, as described above, the cloth fell $W_1$ is protected against beating by the reed 6. Under the circumstances, the weft existing near the cloth fell $W_1$ in the state not woven fixedly is prevented from being displaced upwardly or downwardly (i.e. in the thicknesswise direction), whereby generation of a wavy set mark which may otherwise happen due to the weft insertion failure eliminating processing can positively be excluded.

Upon completion of the weft insertion failure eliminating processing, the loom motor M is rotated reversely at a low speed, as indicated by the curve $q_2$, as a result of which the loom is revolved reversely at a slow speed through a loom revolution angle $\theta_2$) to a weaving start position. In this manner, sufficient beating force or effort can be assured at the restart of the weaving operation. During the slow reverse rotation, the reed 6 passes through the beating position P. However, the cloth fell $W_1$ is protected against beating by the reed 6 because the former has previously been retracted from the weaving start position, thus causing no generation of a wavy set mark. Further, the feed-out motor 1 and the wind-up motor 18 are also rotated reversely at a low speed in synchronism with the loom motor M, as indicated by the curves $q_2$ and $r_2$, respectively. As a result of this, the cloth fell $W_1$ is moved back to the weaving start position $\theta_2$ by a distance proportional to the low-speed (slow) reverse rotation.

It should be noted that a mechanism for rotating forwardly at a low speed the loom motor instead of rotation in the reverse or backward direction may be adopted for positioning the loom at the weaving start position. In that case, the feed-out motor 1 as well as the wind-up motor 18 will be controlled to perform a slow forward rotation.

After the slow reverse revolution of the loom to the weaving start position $\theta$, the feed-out motor 1 is rotated reversely at a low speed by a predetermined amount $Q_1-$ in synchronism with reverse rotation of the wind-up motor 18 by a predetermined amount $R_1-$, as illustrated in FIG. 5, whereby the warps T are pulled back by a predetermined amount $\rho_0$ with the cloth W being unwound by the predetermined amount $\rho_0$, resulting in that the cloth fell $W_1$ is restored to the normal position P.

As will be understood from the above description, the control computer $C_0$ is imparted with a first control function for driving cloth-fell displacing means constituted by the motors 1 and 18 to first displace the cloth fell from the normal position in the cloth uptake direction by a predetermined amount through slow rotation of the motors 1 and 18 and a second control function to allow the cloth fell to resume the normal position after completion of the abovementioned low-speed reverse rotation.

After restoration of the cloth fell $W_1$ to the normal position P, the loom motor M, the feed-out motor 1 and the wind-up motor 18 start forward rotation in synchronism with one another to thereby restart the weaving operation, as indicated by curves $D_1'$, $D_2'$ and $D_3'$.

Upon inputting of a weaving operation stop signal $S_2$ which is produced by a warp breakage detector D2 or a stop switch 17*b* for other failures than a weft insertion failure, the control computer $C_0$ is set to the state ready for receiving an ON signal from either the start switch 17*a*, a slow reverse rotation switch 17*c* or a slow forward rotation switch 17*d*.

Figure 6:
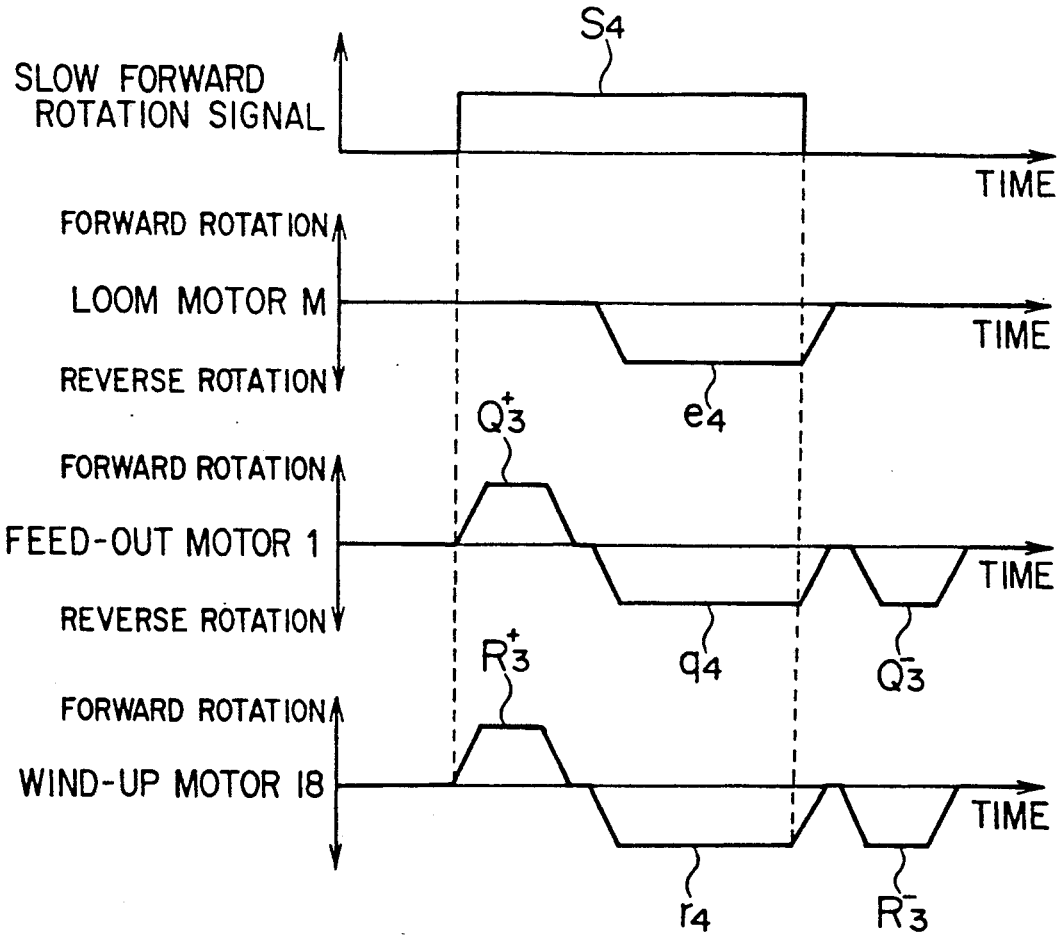

When a fault on the woven fabric or cloth W is to be remedied, the low-speed reverse rotation switch 17*c* is turned on. Upon inputting of an ON signal $S_4$ from the slow reverse rotation switch 17*c*, the feed-out motor 1 is rotated forwardly by a predetermined amount $Q_3+$ and at the same time the wind-up motor 18 is also rotated forwardly by a predetermined amount $R_3+$ at a low speed, before the loom motor M is rotated at a low speed, as shown in FIG. 6. As a result of this, the cloth fell $W_1$ is moved in the cloth W uptake direction from the normal position P, as shown in FIG. 3, whereby the cloth fell $W_1$ is prevented from being beaten by the swinging reed 6.

After the cloth fell $W_1$ has been retracted from the beating position P, the loom motor M, the feed-out motor 1 and the wind-up motor 18 are rotated in the reverse direction in synchronism with one another in response to the ON-state of the slow reverse rotation switch 17*c*, as indicated by curves $e_4$, $q_4$ and $r_4$, respectively. When the slow reverse rotation switch 17*c* is turned off, rotations of the loom motor M, feed-out motor 1 and the wind-up motor 18 are stopped, whereupon the feed-out motor 1 is rotated reversely by a predetermined amount $Q_3-$ with the wind-up motor 18 being also rotated reversely at a low speed for a predetermined angular distance $R_3-$. As a result of this, the warps T are withdrawn slowly by a predetermined distance $\rho_0$ with the cloth W being also unwound by the predetermined distance $\rho_0$, whereby the cloth fell $W_1$ can resume the normal position P. In this manner, in the case of the low-speed reverse rotation for remedying a fault on the woven fabric, the cloth fell $W_1$ is retracted from the region in which the cloth fell is beaten by the reed 6, whereby generation of a wavy set mark due to interference between the reed 6 caused to swing slowly and the cloth fell $W_1$ can be prevented.

Figure 7:
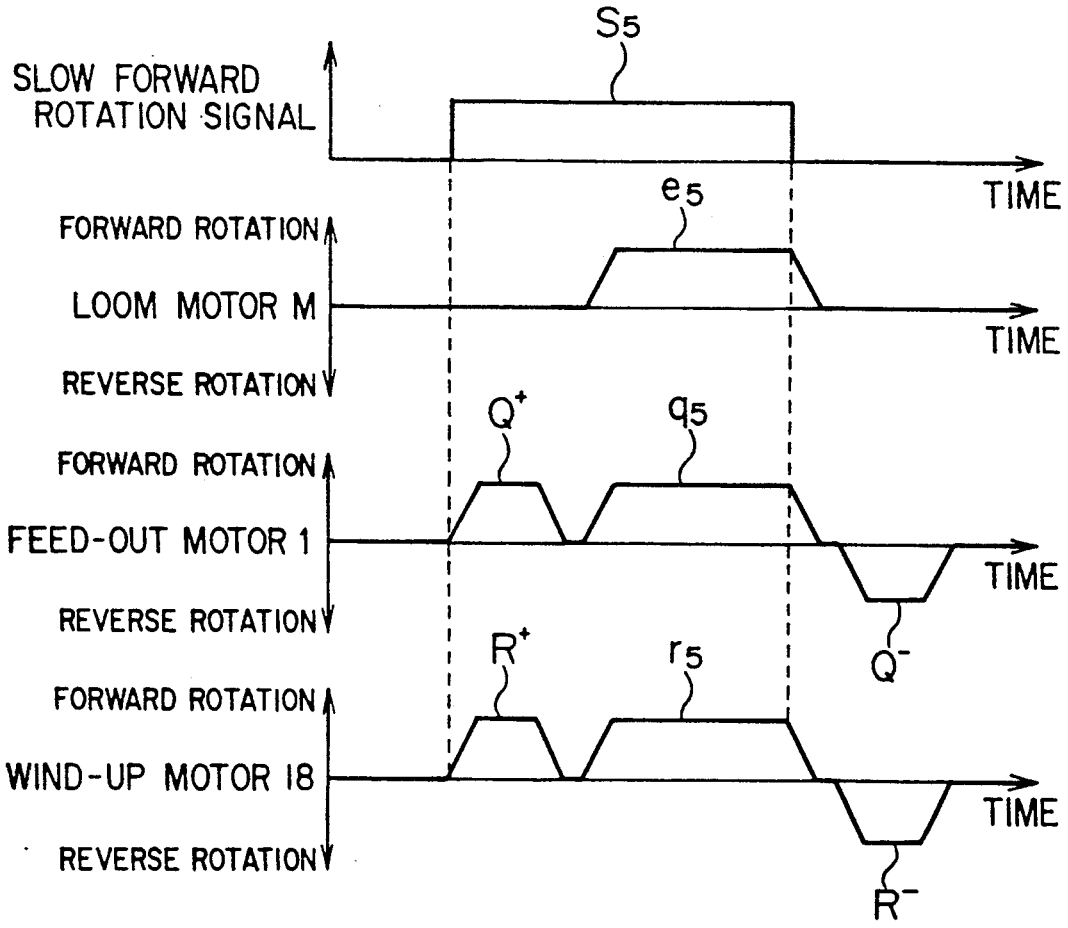

In the operation for remedying the fault on the woven fabric, ON/OFF operation of the slow reverse rotation switch 17*c* may be effected a number of times corresponding to the number of wefts which are required to be pulled out for remedying the fault. For the cloth fell positioning to be finally effected, the slow foward rotation switch 17*d* may be used. It should be noted that in the case of the low-speed or slow forward rotations of the motors M, 1 and 18 (indicated by curves $e_5$, $q_5$ and $r_5$) in response to the ON/OFF operation of the low-speed forward rotation switch 17*d* indicated by a curve $S_5$ in FIG. 7, the moves of the cloth fell $W_1$ are effected in the same manner as in the case of the ON/-OFF operation triggered by the slow reverse rotation switch 17*c*.

When the loom is stopped upon occurrence of weft insertion failure, the loom is automatically rotated to the predetermined weaving start position. On the other hand, when the loom is stopped due to other causes than weft insertion failure, the control computer $C_0$ causes the loom crankshaft to reversely rotate to the predetermined start position $\theta_2$ in response to the ON signal $S_3$ inputted by the start switch 17*a*, as is shown in FIG. 5 at a right-hand side thereof.

Prior to the slow reverse rotation of the individual motors M, 1 and 18 indicated by the curves $e_3$, $q_3$ and $r_3$ shown in FIG. 5, the cloth fell $W_1$ is displaced in the same manner as previously described, and after the slow reverse revolution of the loom to the start position, the cloth fell $W_1$ is restored to the normal position P. During the slow revolution of the loom to the start position P, the reed 6 passes through the beating position P. However, the cloth fell $W_1$ is protected against beating by the reed 6 because it is retracted from the beating position P.

Incidentally, it should be mentioned that the amount or distance by which the cloth fell $W_1$ is retracted from the normal position P in the uptake direction of the woven fabric W is selected to be a necessary minimum in order to minimize the positional error possibly involved in the restoration of the cloth fell to the normal position although it depends on the types of cloths.

In conjunction with the above embodiment, such modification may be made that the cloth fell is displaced by either one of the feed-out motor or the wind-up motor. In that case, however, there may arise such situation in which displacement of the cloth fell for the retraction does not coincide with that for the restoration because of variation in the tension of the warp. For realizing the coincidence in both displacements, it is required to differ more or less the slow forward rotation of the feed-out motor or the wind-up motor from the slow reverse rotation thereof. In any case, the effect of preventing formation of a wavy set mark can be achieved, as in the case of the embodiment described above.

According to the teachings of the invention described above by reference to FIGS. 1 to 7, generation or formation of a weaving bar is prevented by adjusting or controlling the position of the cloth fell. It should however be mentioned that such generation of a weaving bar can equally be prevented by adjusting the tension of the warp. In this case, the mechanical structure may be implemented substantially same as that shown in FIG. 1 except that the wind-up motor 18 and the rotary encoder 18*a* can be spared.

Referring now to FIG. 1, the control computer $C_0$ controls the rotation speed of the feed-out motor 1 on the basis of the result of comparison between a preset warp tension $F_0$ and a detected warp tension F represented by the input signal supplied from the load cell 15 and the warp beam diameter represented by the output signal of the rotary encoder 16 for detecting the loom revolution angle. In this manner, the warp tension $F_0$ is controlled in the ordinary operation to prevent occurrence of a weaving bar. The control computer $C_0$ responds to the ON signal from the start switch 17*a* to command the forward rotation of the feed-out motor 1, while controlling the rotation speed of the feed-out motor 1 on the basis of the rotation speed signal supplied from the rotary encoder 1*a* incorporated in the feed-out motor 1 through a feedback control loop.

The input unit 31 connected to the control computer $C_0$ is used also for setting the warp tension during slow loom revolution occurring when the weaving operation is stopped or suspended. More specifically, a warp tension $F_1$ during slow reverse revolution of the loom upon occurrence of the weft insertion failure and a warp tension $F_2$ during slow reverse revolution of the loom effected upon breakage of the warp are set through the input unit 31 by observing analytically the generation of a weaving bar in a trial weaving after exchange of the warp beam. By way of example, when a weaving bar formed due to the slow reverse revolution of the loom effected upon occurrence of a weft insertion failure tends to be thick, the tension $F_1$ is set lower than the normal tension $F_0$ and vice versa.

The control computer $C_0$ performs warp tension changing control in accordance with the tension changing control information inputted through the input unit 31.

Figure 8:
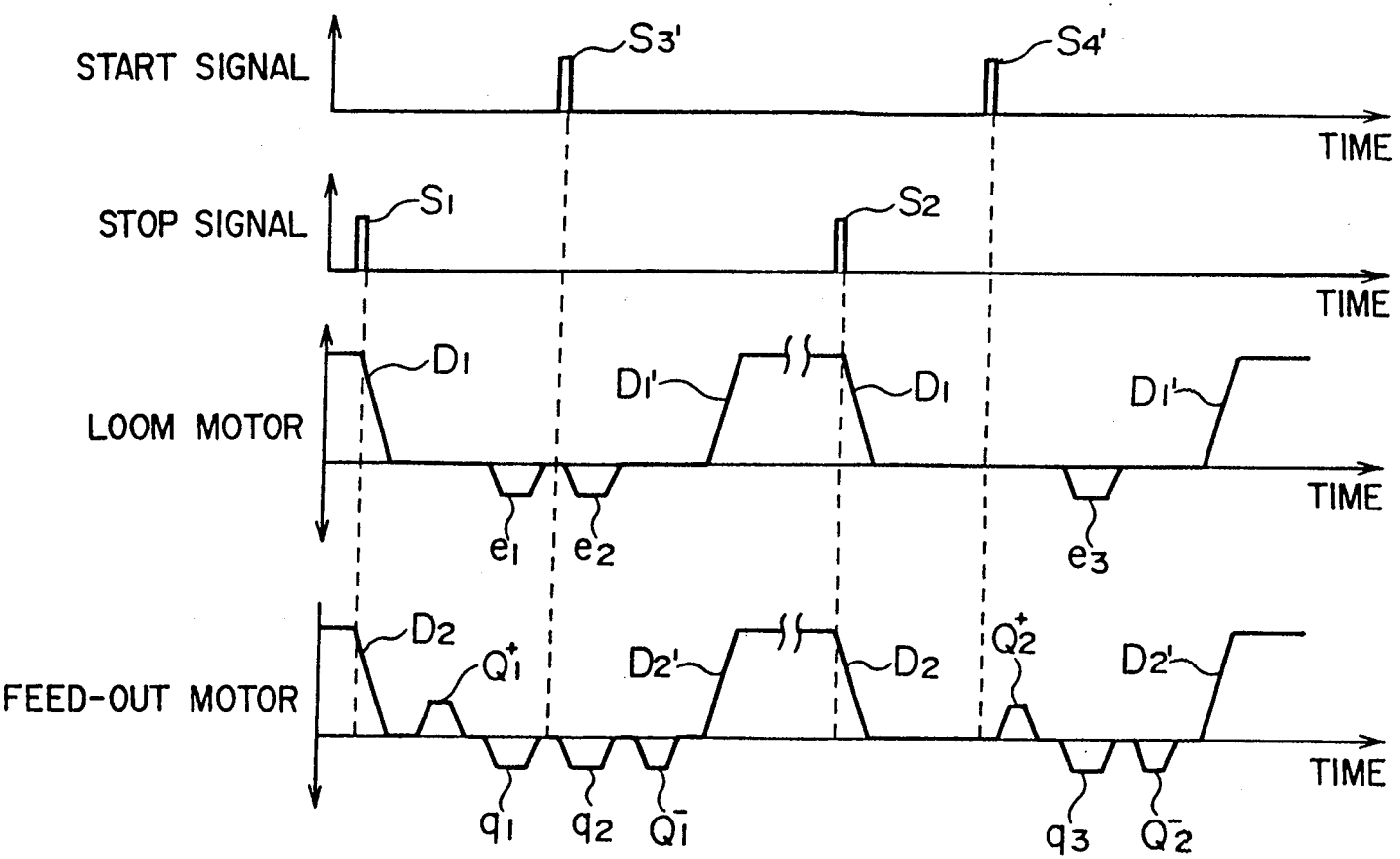
FIG. 8 is a view for graphically illustrating a warp tension control in the weaving bar generation preventing apparatus according to a second embodiment of the present invention.

More specifically, the control computer $C_0$ responds to abnormality detection signals outputted from the weft insertion failure detector D1 and the warp breakage detector D2 or an ON signal produced by the stop switch 17*b* to command stoppage of operation of the loom motor M and the feed-out motor 1, whereby the motor M and 1 are caused to stop in synchronism with one another, as indicated by curves $D_1$ and $D_2$ shown in FIG. 8. As a result of this, the warp feeding is interrupted while the reed 6 is caused to stop at a position immediately before the beating position indicated by a broken line in FIG. 3.

In case the weaving stop signal $S_1$ shown in FIG. 8 originates in the weft insertion failure detector D1, the control computer $C_0$ responds to the signal $S_1$ by issuing a command for the feed-out motor 1 to effect a low-speed or slow forward rotation when $F_1 < F_0$, while the computer $C_0$ commands a slow reverse rotation when $F_1 > F_0$. The slow forward rotation of the feed-out motor 1 causes the warp tension F to be lowered, while the slow reverse rotation of the motor 1 causes the warp tension F to be increased. In the description of the instant embodiment, it is assumed that $F_1 < F_0$. The slow operation of the feed-out motor 1 is performed until the detected warp tension F coincides with the preset warp tension $F_1$. At the time point when the tension F becomes equal to the preset value $F_1$, the slow operation of the feed-out motor 1 is stopped.

After the slow operation of the feed-out motor 1 for changing the warp tension has been executed in the manner as illustrated by a curve $Q_1+$ shown in FIG. 8, the weft insertion failure eliminating processing is performed. Upon occurrence of the weft insertion failure, the weft insertion failure eliminating processing may be carried out by using a weft processing apparatus such as disclosed, for example, in JP-A-H2-61138, as in the case of the preceding embodiment. The weft insertion failure eliminating processing is performed in the state where the weft of concern beaten onto the cloth fell $W_1$ is released from the gripping action of the warps T. To this end, the loom is driven in the reverse direction about one and a half rotation at a low speed. Through this slow reverse revolution of the loom, the reed 6 is caused to pass through the normal position P, i.e. the beating position before the cloth fell $W_1$.

After the slow forward rotation of the feed-out motor 1 for adjusting the warp tension, the loom motor M is rotated at a low speed in the reverse direction about one and a half revolution, as indicated by the curve $e_1$ in FIG. 8, whereby the loom is caused to revolve in the backward or reverse direction to a position where a maximum opening span is formed between the warps T. The reed 6 is moved to the most retracted position indicated in FIG. 1, resulting in that the warps T form the maximum opening span. Thus, the weft suffering the insertion failure which is positioned at the cloth fell $W_1$ is released from the gripping action exerted by the warps T, making it possible to carry out the weft insertion failure remedying processing.

In synchronism with the slow reverse rotation of the loom motor M, the feed-out motor 1 is rotated at a low speed in the reverse direction, as indicated by the curve $q_1$. Consequently, the warps T are withdrawn slowly by an amount proportional to the low-speed revolution of the loom, whereby the cloth W is unwound backwardly by an amount proportional to the slow reverse revolution of the loom. As a result of the withdrawal of the warps T and the unwinding of the cloth W performed in synchronism with each other, the cloth fell $W_1$ undergoes a positional displacement of magnitude which corresponds to the slow reverse revolution of the loom.

Upon completion of the weft insertion failure eliminating processing, a start signal $S_3'$ automatically inputted to the control computer $C_0$, whereby the loom motor M is rotated reversely at a low speed, as indicated by the curve $e_2$, as a result of which the loom is revolved reversely at a slow speed to the weaving operation start position. In this manner, a sufficient beating force or effort can be assured for restarting the weaving operation.

The feed-out motor 1 is also rotated reversely at a low speed in synchronism with the loom motor M, as indicated by the curves $e_2$. As a result, the cloth fell $W_1$ is pulled back to the weaving start position by a distance proportional to the slow reverse rotation.

In the course of slow reverse revolution of the loom about one and a half rotation, the reed 6 passes through the normal cloth-fell position, i.e. the beating position, whereby the cloth fell $W_1$ is beaten by the reed 6. Further, for the purpose of avoiding insufficient beating effort, the reed 6 passes through the beating position during the slow reverse revolution of the loom as well, to thereby beat the cloth fell $W_1$. In this conjunction, it should however be noted that the warp tension is reduced lower than the tension $F_0$ in the weaving operation prior to the slow reverse revolution of the loom for the weft insertion failure eliminating processing and that the warp tension is reduced to a level sufficient for avoiding occurrence of a thick weaving bar. Consequently, through the slow reverse revolution of the loom, the cloth fell $W_1$ and the reed 6 are caused to bear against each other with a force appropriate for preventing the occurrence of a weaving bar. In this manner, by setting properly the warp tension $F_2$ in association with the slow revolution of the loom by taking into account the trend of generation of a weaving bar due to the slow loom motion upon occurrence of breakage of the warp, the weaving bar can be prevented from generation due to the slow loom motion which is performed in accompanying the occurrence of warp breakage.

There may be adopted a system for rotating slowly the loom motor M in the forward direction instead of the reverse or backward direction for positional alignment of the loom with the weaving start position. In that case, the feed-out motor 1 is also rotated slowly in the forward direction.

After the slow reverse revolution of the loom to the weaving start position, the feed-out motor 1 is rotated reversely or backwardly at a low speed, as indicated by the curve $Q_1^-$ shown in FIG. 8. This slow reverse rotation of the feed-out motor 1 is performed until the detected warp tension F becomes equal to the normal tension $F_0$ set previously for the weaving. At the time point when $F=F_0$, the slow reverse rotation of the feed-out motor 1 is stopped. The cloth fell $W_1$ is constantly maintained at the normal position even during the slow reverse revolution of the loom owing to the synchronous slow reverse rotation of the feed-out motor 1. Thus, upon restarting of the weaving, the beating position coincides with that of the cloth fell.

After restoration of the warp tension to the tension $F_0$ preset for the weaving operation, the loom motor M and the feed-out motor 1 are triggered to perform the forward rotations, as indicated by curves $D_1'$ and $D_2'$, respectively, whereby the weaving operation is started.

Upon inputting of the weaving operation stop signal $S_2$ which is produced by the warp breakage detector D2 or the stop switch 17*b* for other failures than weft insertion failure, the control computer $C_0$ is set to the state ready for receiving an ON signal $S_4'$ from the start switch 17*a*.

In response to the input of the ON signal $S_4'$ from the start switch 17*a* after having processed the warp breakage, the control computer $C_0$ rotates forwardly the feed-out motor 1 at a low speed, as indicated by a curve $Q_2^+$ shown in FIG. 8. This slow forward rotation of the feed-out motor 1 is performed until coincidence is established between the detected warp tension F and the preset warp tension $F_2$, whereupon the slow forward rotation of the feed-out motor 1 is stopped.

After the slow forward rotation of the feed-out motor 1 has been stopped, the loom motor M is rotated backwardly, as indicated by the curve $e_3$, while the loom is revolved slowly to the weaving start position located immediately before the beating position. This is for the purpose of avoiding the insufficient beating force or effort at the start of the weaving operation. The feed-out motor 1 is slowly rotated in the reverse direction in synchronism with the slow reverse rotation of the loom motor M, as indicated by the curve $e_3$. As a result of this, the cloth fell $W_1$ is withdrawn by an amount proportional to the slow reverse revolution of the loom to the weaving start position.

For avoiding the poor beating, the reed 6 is caused to pass through the beating position in the course of the slow reverse revolution of the loom, to thereby beat the cloth fell $W_1$. In this connection, it should however be noted that the warp tension is set lower than the tension $F_0$ in the weaving operation prior to the slow reverse revolution of the loom for the weft insertion failure eliminating processing and that the warp tension is reduced to a level sufficient for avoiding generation of a thick weaving bar. Consequently, even though the cloth fell $W_1$ and the reed 6 are caused to bear against each other during the reverse revolution of the loom, formation of a weaving bar can successfully be avoided.

The trend of generation of a weaving bar accompanying the processing for eliminating warp breakage failure (i.e. trend with respect to difference in the thickness of the weaving bar, outer appearance thereof etc.) differs from the trend of generation of a weaving bar in the processing for eliminating a weft insertion failure due to difference in the slow loom motion. Consequently, when the warp tension is set invariable consistently throughout the slow loom motions, generation of a weaving bar can not be prevented in the case of warp breakage remedying processing performed in a manner similar to the processing for eliminating weft insertion failure. Under the circumstances, the warp tension $F_2$ is properly selected for the slow loom motion performed upon occurrence of warp breakage by taking into consideration the trend of generation of a weaving bar mentioned above so that the beating force during the slow loom motion is so adjusted as to prevent the generation of a weaving bar due to the slow loom motion performed for remedying warp breakage failure.

After the loom has been backwardly rotated to the weaving start position at a low speed, the feed-out motor 1 is slowly rotated in the reverse direction, as indicated by the curve $Q_2^-$ shown in FIG. 8. This slow reverse rotation of the feed-out motor 1 is so performed that the detected warp tension F becomes equal to the preset tension $F_0$ for the weaving operation, whereupon the slow reverse rotation of the motor 1 is stopped. The cloth fell $W_1$ is constantly maintained at the normal position owing to the synchronous slow reverse rotation of the feed-out motor 1 even during the slow reverse revolution of the loom.

After the warp tension has been restored to the tension $F_0$ set for the weaving operation, the forward rotations of the loom motor M and the feed-out motor 1 are triggered, as indicated by the curves $D_1'$ and $D_2'$, respectively, whereby the weaving operation is restarted.

The processing flows described above may be so modified that the warp tension is changed during the slow loom motion performed in the weaving operation suspended state by making use of the amounts $q^+$, $q^-$; $r^+$, $r^-$ of slow rotation of the feed-out motor 1 as set. The corresponding data $q^+$, $q^-$; $r^+$, $r^-$ are preliminarily loaded through the input unit 31, whereby the warp tension is subjected to an open loop control. The quantity $q^+$ corresponds to the change in the warp tension upon occurrence of weft insertion failure, while the quantity $q^-$ corresponds to the resumption of the weaving-destined warp tension to be validated after the weft insertion failure eliminating processing. On the other hand, the quantity $r^+$ corresponds to the change in the warp tension upon occurrence of warp breakage, while $r^-$ corresponds to restoration to the warp tension for the weaving at the restart of the weaving operation.

Incidentally, the warp tension change may equally be performed when a fault of the cloth W is to be remedied by using the slow reverse rotation switch 17*c* and the slow forward rotation switch 17*d*.

Figure 9:
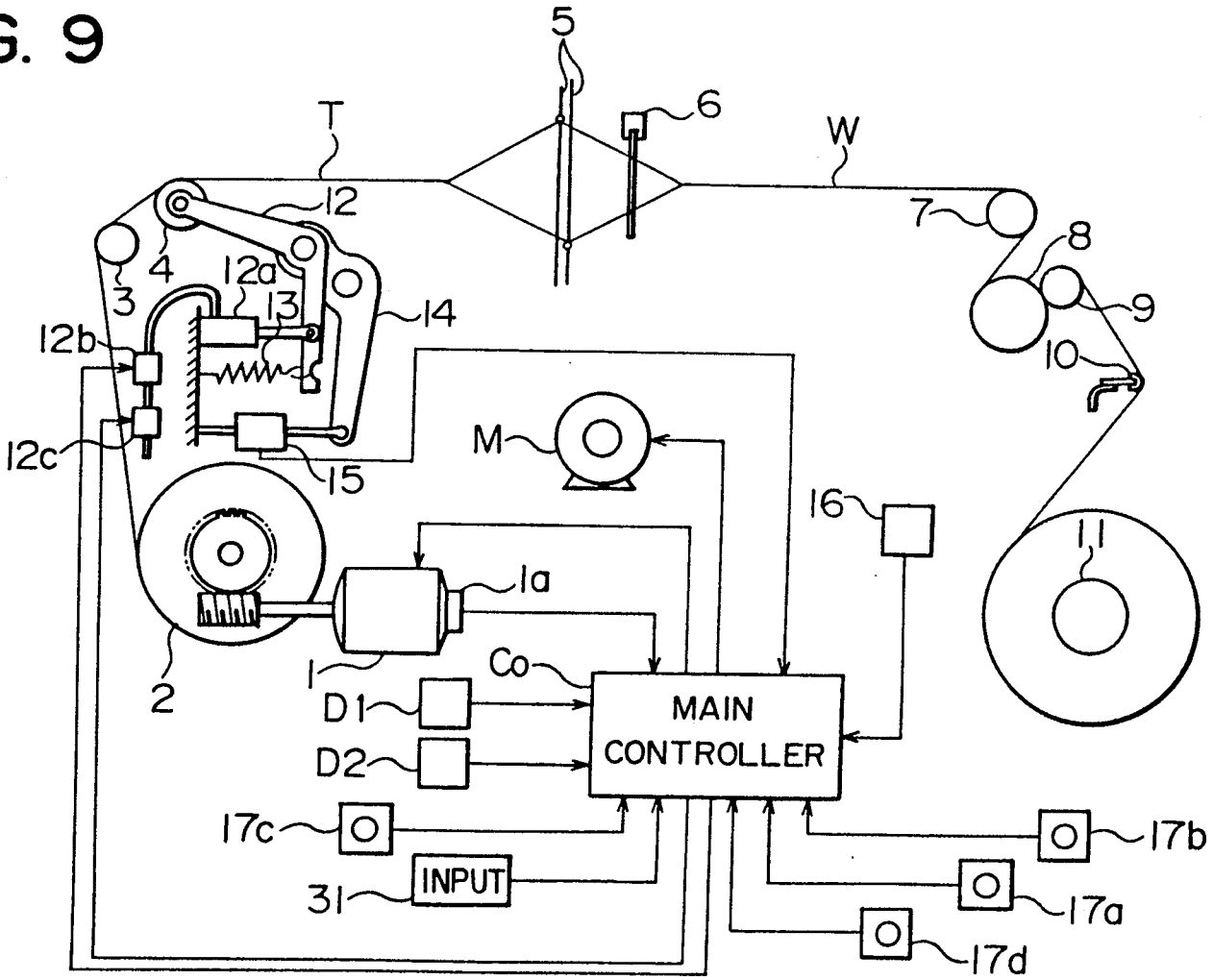
FIG. 9 is a schematic side elevational view showing generally a loom incorporating a weaving bar generation preventing apparatus according to a modification of the second embodiment.

In conjunction with the embodiment now described above, it has been described that the warp tension control performed during the slow loom motion in the state in which the weaving operation is suspended is effectuated by using the feed-out motor 1. It should however be mentioned that the warp tension may be changed by angularly displacing the tension lever 12 by means of an air cylinder 12*a*, as shown in FIG. 9. In this connection, the air supply to the air cylinder 12*a* is controlled by an electromagnetic three-way valve 12*b* which is provided with a discharge port and which is energized and deenergized under the control of the control computer $C_0$. Further, the control computer $C_0$ is adapted to control an electromagnetic air-pressure regulator 12*c*.

Ordinarily, the electromagnetic three-way valve 12*b* is in the deenergized state (i.e. discharge-port opened state), and the tension lever 12 is not placed under the influence of the air cylinder 12*a*. The electromagnetic three-way valve 12*b* is electrically energized upon activation of the slow loom motion in the weaving operation suspended state, as a result of which the air pressurized at a level preset by the pressure regulator 12*c* is supplied to the air cylinder 12*a*. Under the influence of the preset air pressure, the warp tension can be changed correspondingly. Of course, the air pressure is set at different levels corresponding to weft insertion failure and warp breakage, respectively. The control computer $C_0$ controls the settings of the pressure level at the regulator 12*c* in correspondence to weft insertion failure and warp breakage failure, respectively.

Figure 10:
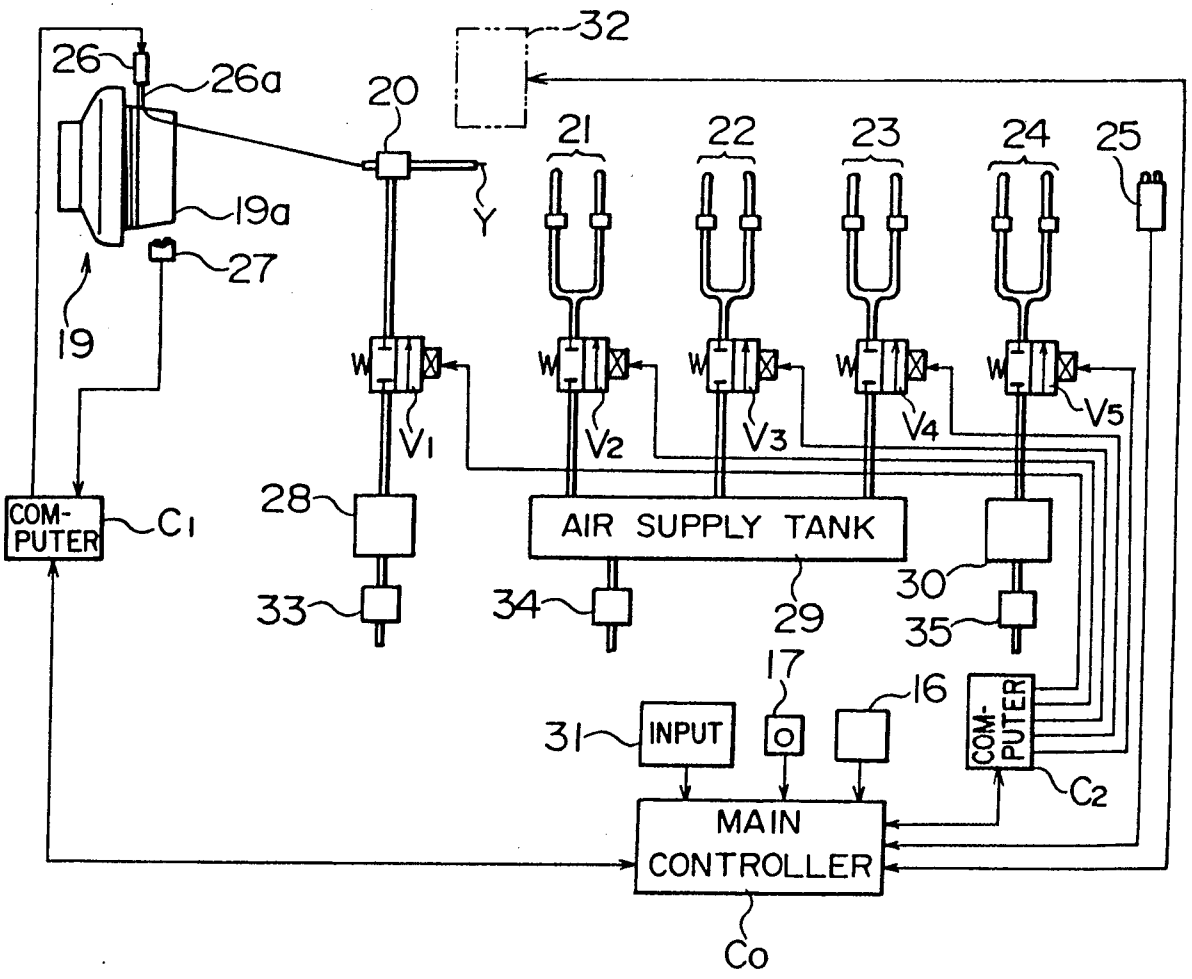
FIG. 10 is a schematic view showing a weaving bar generation preventing apparatus incorporating a one-shot (single-shot) weft insertion control circuit according to a third embodiment of the present invention.
Figure 11:
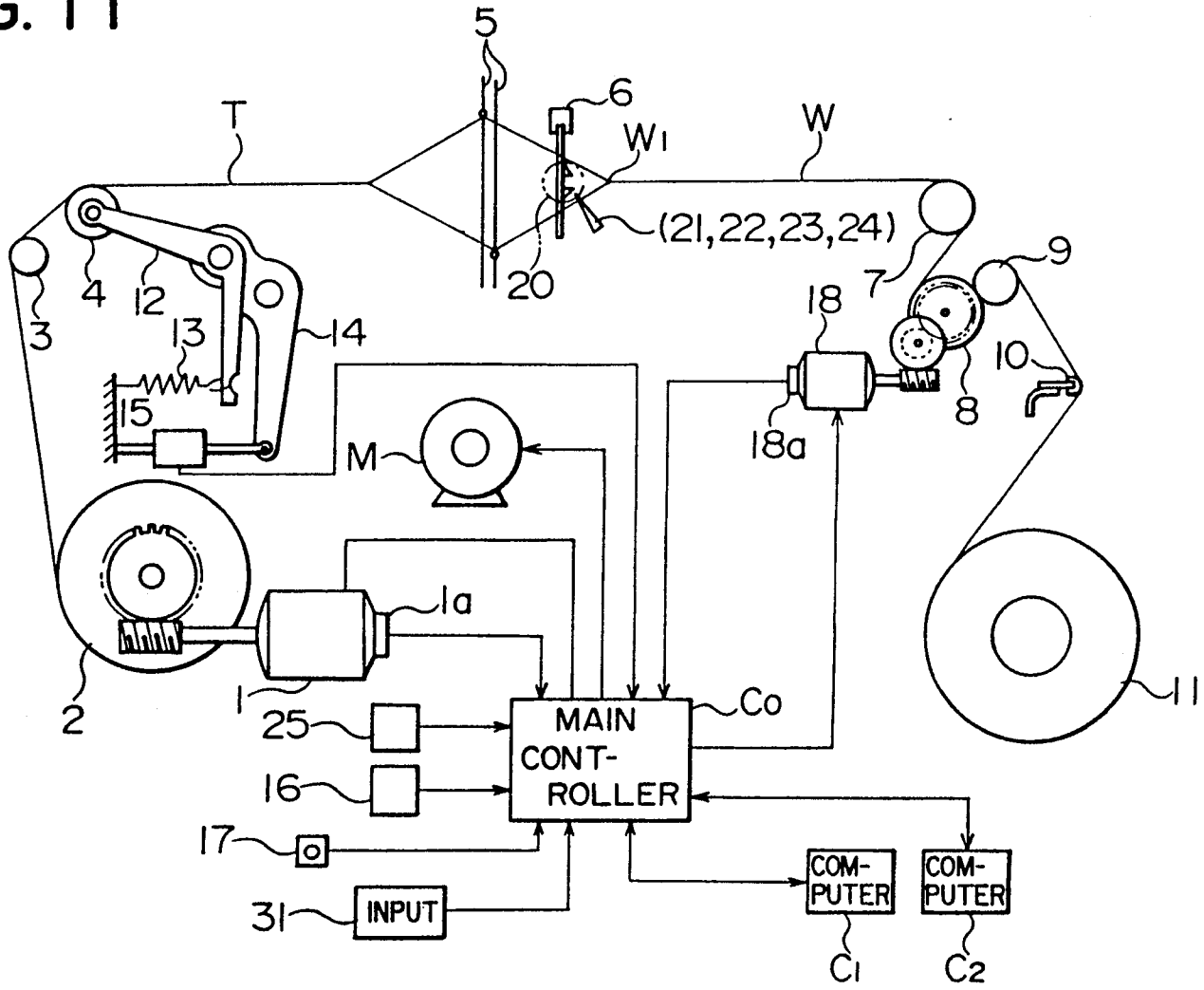
FIG. 11 is a schematic side elevational view showing generally a loom provided with the weaving bar generation preventing apparatus shown in FIG. 10.

Next, description will be made of a further embodiment of the present invention. FIG. 10 shows only schematically a structure of a weft inserting apparatus which is combined with a weaving bar suppressing apparatus designed to carry out the method according to the invention. In FIG. 10, a reference numeral 19 denotes a winding type weft length measuring and storing apparatus. In an ordinary or normal operation, a weft Y measured in length and stored in the weft length measuring and storing apparatus 19 and ejected from a weft inserting main nozzle 20 is inserted in a weft insertion passage and flies or runs therethrough under the relay action of air jets produced by a plurality of auxiliary weft inserting nozzles 21, 22, 23 and 24. Disposed on the weft receiving end is a weft detector 25 which may be constituted by a reflection type photoelectric sensor to acquire information for deciding whether or not a leading end of the weft Y has reached a predetermined terminal position.

Drawing or unwinding of the weft from a weft winding surface 19*a* of the weft length measuring and storing apparatus 19 as well as the stopping thereof is effectuated through energization and deenergization of an electromagnetic solenoid 26 which drives a retaining pin 26*a*. On the other hand, the energization/deenergization of the electromagnetic solenoid 26 is controlled under command of an auxiliary control computer $C_1$. This computer controls the energization/deenergization of the electromagnetic solenoid 26 on the basis of loom rotation angle detection information supplied from the main control computer $C_0$.

Disposed in the vicinity of the weft winding surface 19*a* is a weft unwinding detector 27 which may be constituted by a reflection type photoelectric sensor which is adapted to detect the weft Y unwound and led out from the weft winding surface 19*a*. When the number n of times the weft is unwound from the weft unwinding detector 27 has reached a predetermined number N, the auxiliary control computer $C_1$ issues a command for deenergization of the electromagnetic solenoid 26, which results in that the retaining pin 26*a* engages the weft winding surface 19*a* to prevent the weft from being further unwound and led out.

Ejection of pressurized air for weft insertion from the weft inserting main nozzle 20 is controlled through energization/denergization of the electromagnetic valve $V_1$, while the pressurized air ejections from the auxiliary weft inserting nozzles 21 to 24 are controlled through energization/deenergization of electromagnetic valves $V_2$, $V_3$, $V_4$ and $V_5$. The electromagnetic valve $V_1$ is connected to a pressurized air supply tank 28, wherein the pressure within the tank 28 is regulated by a pressure control valve 33. The electromagnetic valves $V_2$ to $V_4$ are connected to a pressurized air supply tank 29 the pressure within which is regulated by a pressure control valve 34. The electromagnetic valve $V_5$ is connected to a pressurized air supply tank 30 the pressure within which is regulated by a pressure control valve 35. The energization/deenergization control of the individual electromagnetic valves $V_1$, $V_i$ ($i=2, \ldots,$ 5 in the case of the illustrated embodiment) is effectuated under command of the auxiliary control computer $C_2$. More specifically, the auxiliary control computer $C_2$ controls energization/deenergization of the individual valves $V_1$, $V_i$ on the basis of the detected loom rotation angle information available from the main control computer $C_0$.

The energization and deenergization of the electromagnetic valves $V_1$, $V_i$ are performed successively from one to another, starting from the electromagnetic valve $V_1$ (in a relay-like manner, so to say). Data to this end is loaded in the main control computer $C_0$ through the input unit 31.

Disposed immediately above the weft inserting main nozzle 20 is a weft processing apparatus 32 which may be of a same type as the one disclosed in JP-A-H2-61138 and which serves for preventing insertion of a succeeding weft upon occurrence of insertion failure for a preceding weft as well as for automatic pulling out of the failure suffering weft located on the cloth fell $W_1$ of a woven fabric or cloth W by tracing up the succeeding weft. The weft failure elimination processing is controlled by the main control computer $C_0$.

Information necessary to execute the wavy set mark generation preventing program such as energization and deenergization timing, jet pressure, type of weft, width of cloth and others is loaded in the main control computer $C_0$ through the input unit 31. The main control computer $C_0$ transfers to the auxiliary control computer $C_2$ the timing information for energization/deenergization of the electromagnetic valves $V_1$, $V_i$ for preventing the wavy set mark from making appearance while transferring to the auxiliary control computer $C_1$ the timing information for energization of an electromagnetic solenoid 26 for suppressing the generation of a wavy set mark.

In the following, wavy set mark generation preventing control will be described by reference to FIG. 19 graphically illustrating pressure control and energization/deenergization control for a one-shot weft insertion process.

Figure 12:
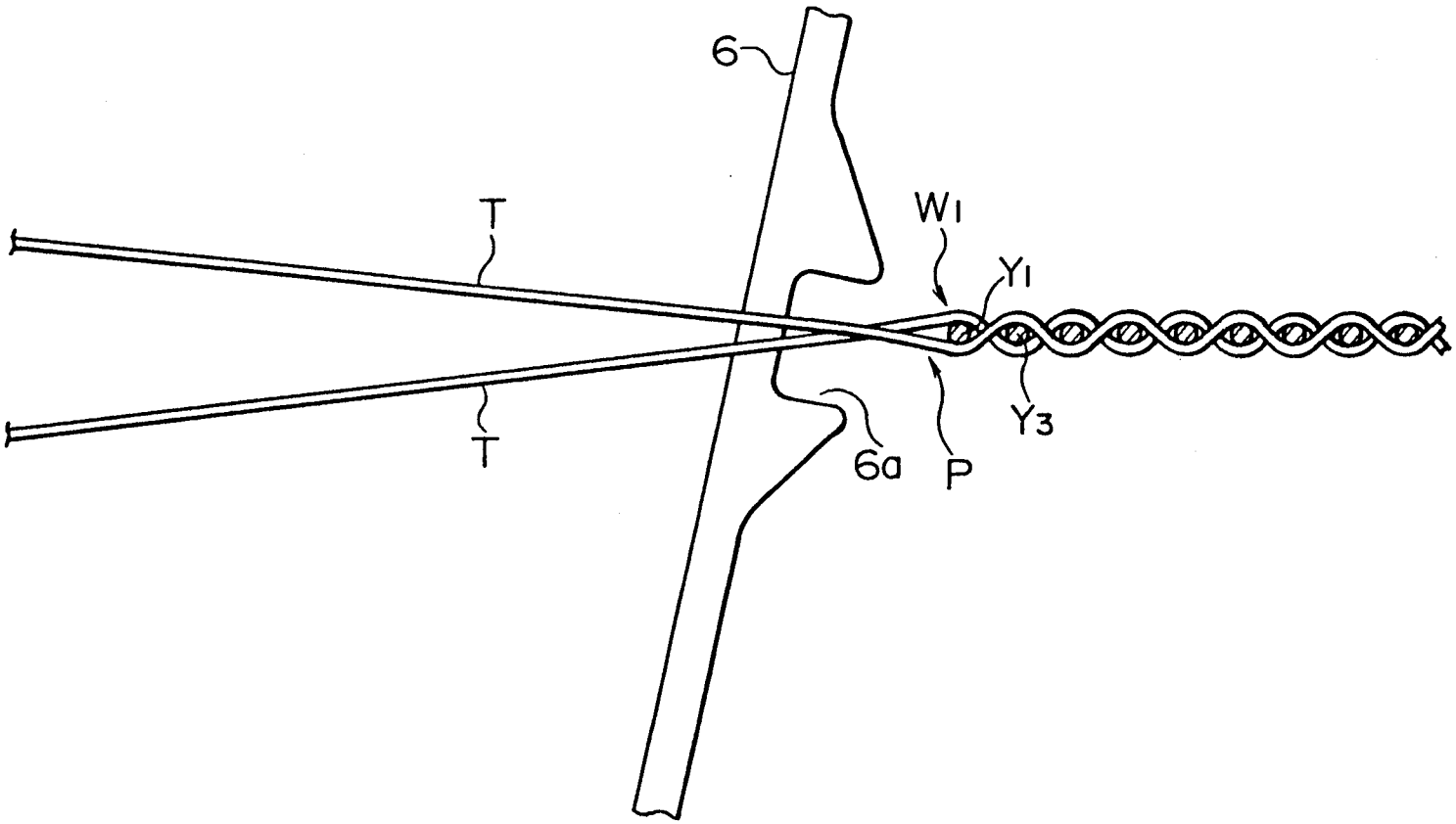
FIG. 12 is an enlarged side view around the cloth fell where a failure suffering weft has been woven.

Upon occurrence of a weft insertion failure, the main control computer $C_0$ issues a command for stopping the operations of the loom motor M, the feed-out motor 1 and the wind-up motor 18 in response to an abnormal detection information outputted from the weft detector 25. The motors M, 1 and 18 are stopped in synchronism with one another, as indicated by curves $D_1$, $D_2$ and $D_3$. Thus, the warp feed-out operation and the cloth wind-up operation are stopped, while the modified reed 6 is caused to stop at a position immediately before the beating position, as shown in FIG. 12. A signal $S_1$ shown in FIG. 19 is a weaving operation stop signal.

Further, in response to occurrence of the weft insertion failure, the weft processing apparatus 32 is brought into operation before the motors M, 1 and 18 are stopped, to thereby prevent a weft from being inserted after the defective weft $Y_1$.

Figure 13:
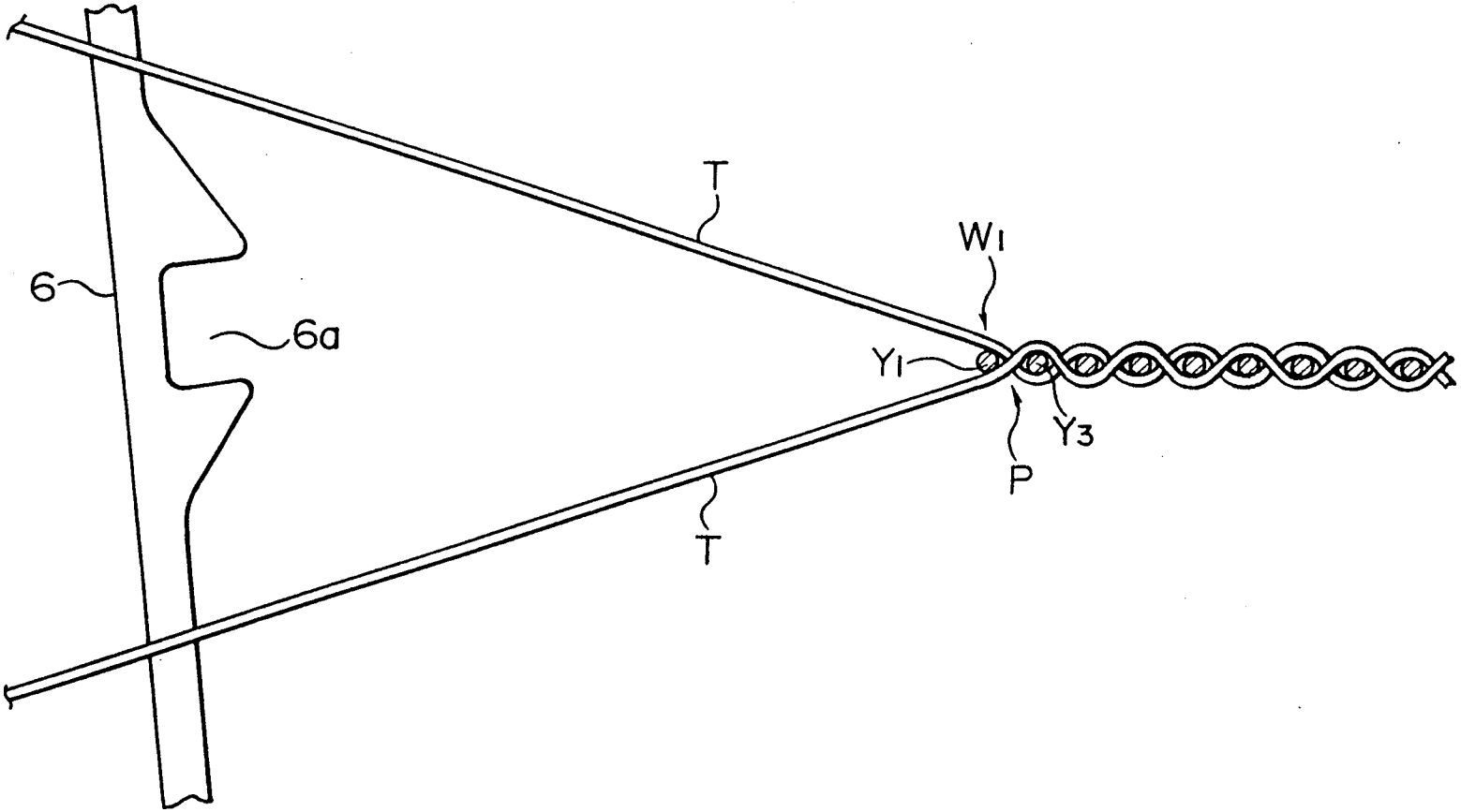
FIG. 13 is an enlarged side elevational view around the cloth fell showing that the failure suffering weft is removed.

As can be seen from the curves $D_4$, $D_5$ and $D_6$, the motors M, 1 and 18 are caused to rotate at a low speed in the reverse direction after having first been stopped. Through the slow reverse rotation of these motors, the loom is caused to revolve about one and a half rotation reversely or backwardly, as a result of which a maximum opening span is formed between the warps, as shown in FIG. 13. Owing to formation of this opening, the failure suffering weft $Y_1$ on the cloth fell $W_1$ is released from the gripping action exerted by the warps T. Subsequently, the failure suffering weft $Y_1$ on the cloth fell $W_1$ is pulled out therefrom to a side of the opening formed between the warps through the pull-out operation performed by the weft processing apparatus 32 by tracing up the succeeding weft.

The modified reed 6 passes through a beating position P before the cloth fell $W_1$ in the course of moving from the position shown in FIG. 12 to the position shown in FIG. 13. Accordingly, if the failure suffering weft $Y_1$ on the cloth fell $W_1$ was not removed, the weft $Y_1$ will be beaten by the modified reed 6 to dislocate upwardly or downwardly, to give rise to generation of a wavy set mark. However, since the failure suffering weft $Y_1$ is pulled outwardly and removed by the weft processing apparatus 32, as mentioned above, the failure suffering weft $Y_1$ will not provide a cause for generation of the wavy set mark.

Through the synchronized slow reverse revolutions of the motors M, 1 and 18, the warps T are withdrawn at a low speed with the cloth W being unwound slowly. Since the amounts of the slow withdrawal and the slow unwinding are identical with each other, the cloth fell $W_1$ undergoes displacement corresponding to the amount of slow reverse revolution of the loom.

Upon completion of the processing for eliminating the weft insertion failure, the main control computer $C_0$ is ready for receiving a start signal $S_2$. Thus, in response to the input start signal $S_2$ produced by turning on the start switch 17, the main control computer $C_0$ outputs a reference signal $S_3$ for starting the one-shot weft inserting operation to the auxiliary control computers $C_1$ and $C_2$.

The auxiliary control computer $C_2$ responds to the weaving stop signal $S_1$ supplied from the main control computer $C_0$ to stop the energization/deenergization control of the electromagnetic valves $V_1$; $V_i$ ($i=2, \ldots, 5$) and assumes the state ready for reception of the abovementioned reference signal $S_3$. In response to the input of the reference signal $S_3$, the auxiliary control computer $C_2$ energizes simultaneously the electromagnetic valves $V_i$ for the auxiliary weft inserting nozzles 21 to 24, all of which start ejections simultaneously, as indicated by an arrow R in FIG. 14. Subsequently, the control computer $C_2$ energizes the electromagnetic valve $V_1$ upon lapse of a predetermined time t from the time point the electromagnetic valves $V_i$ were energized. The valve $V_1$ is deenergized after lapse of a predetermined time.

On the other hand, the auxiliary control computer $C_1$ responds to the weaving operation stop signal $S_1$ supplied from the main control computer $C_0$ to stop the energization/deenergization control of the electromagnetic solenoid 26 and assumes the state ready to receive the reference signal $S_3$. Upon reception of the reference signal $S_3$, the auxiliary control computer $C_1$ energizes the electromagnetic solenoid 26 after lapse of a predetermined time t from the time point when the electromagnetic valve $V_1$ was energized. As a result of this, the retaining pin **26*a* is caused to disengage from the weft winding surface 19*a*, allowing the weft to be unwound and led outwardly from the weft winding surface 19*a***.

Figure 14:
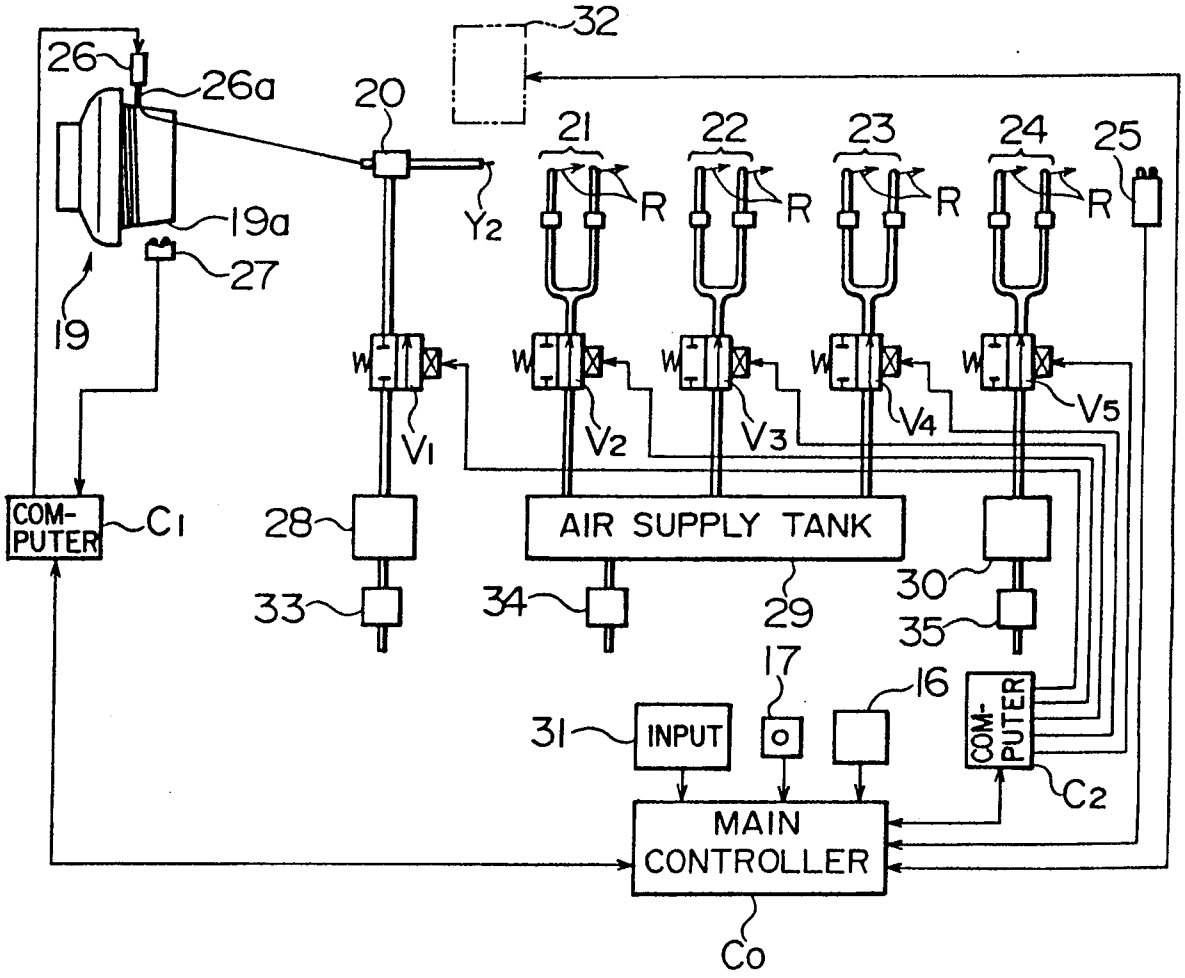
FIG. 14 is a schematic diagram of the weaving bar generation preventing apparatus of FIG. 10, showing that the auxiliary weft inserting nozzles are operated to eject jets prior to the start of a one-shot weft insertion.
Figure 15:
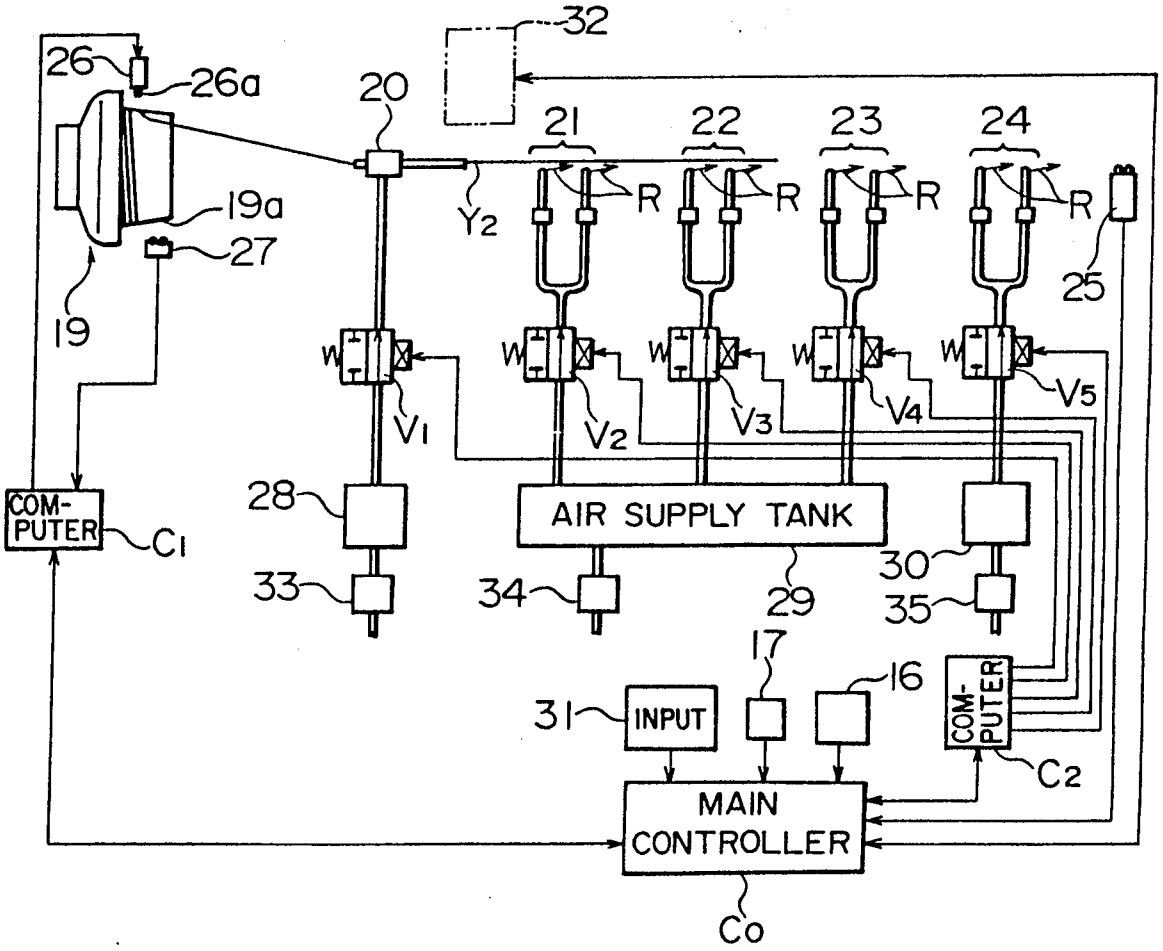
FIG. 15 is a schematic view of the weaving bar generation preventing apparatus of FIG. 10, showing that the main weft inserting nozzle is operated to eject a jet subsequent to the operation of the auxiliary weft inserting nozzles.
Figure 16:
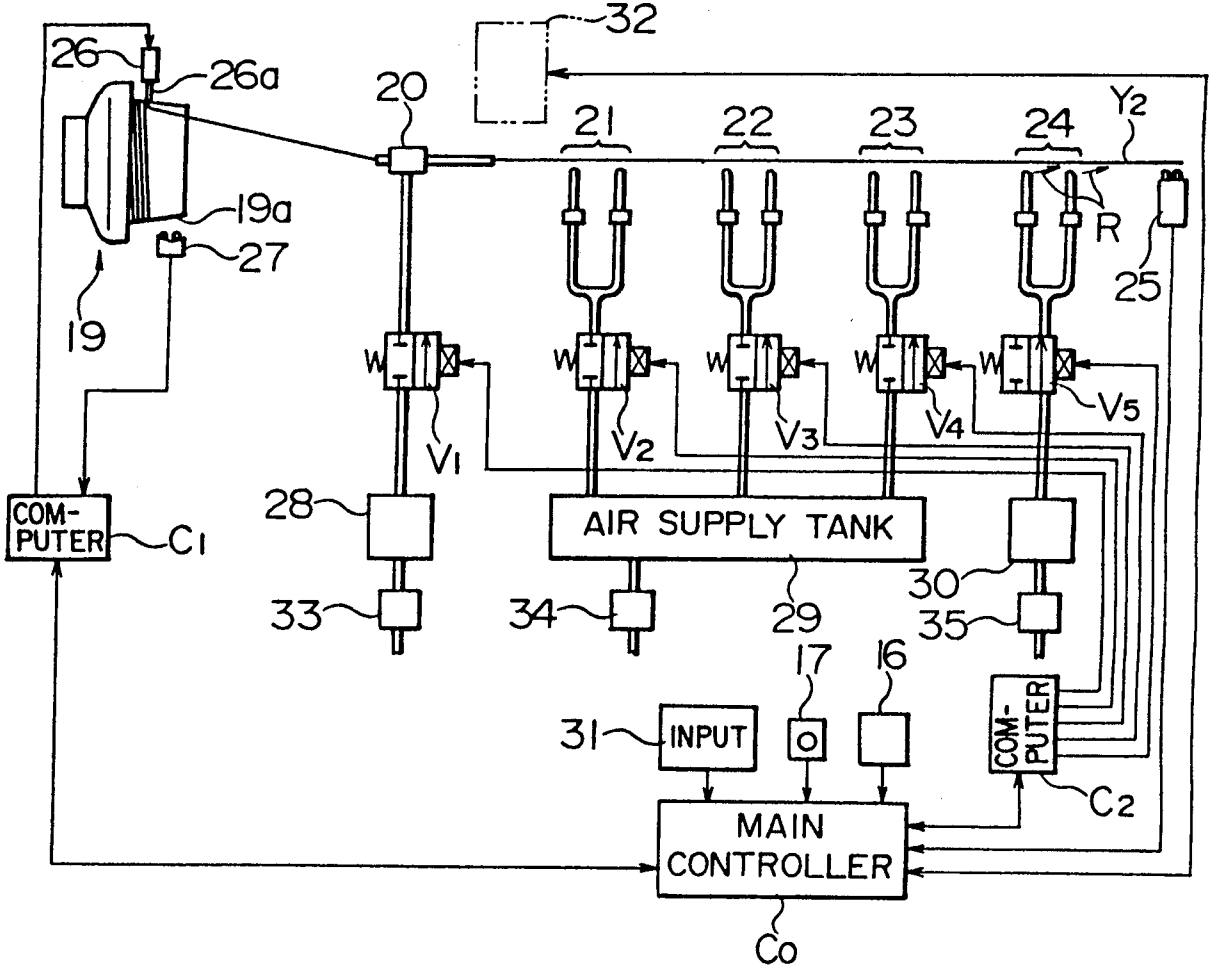
FIG. 16 is a schematic view of the weaving bar generation preventing apparatus of FIG. 10 for illustrating the one-shot weft insertion process.
Figure 19:
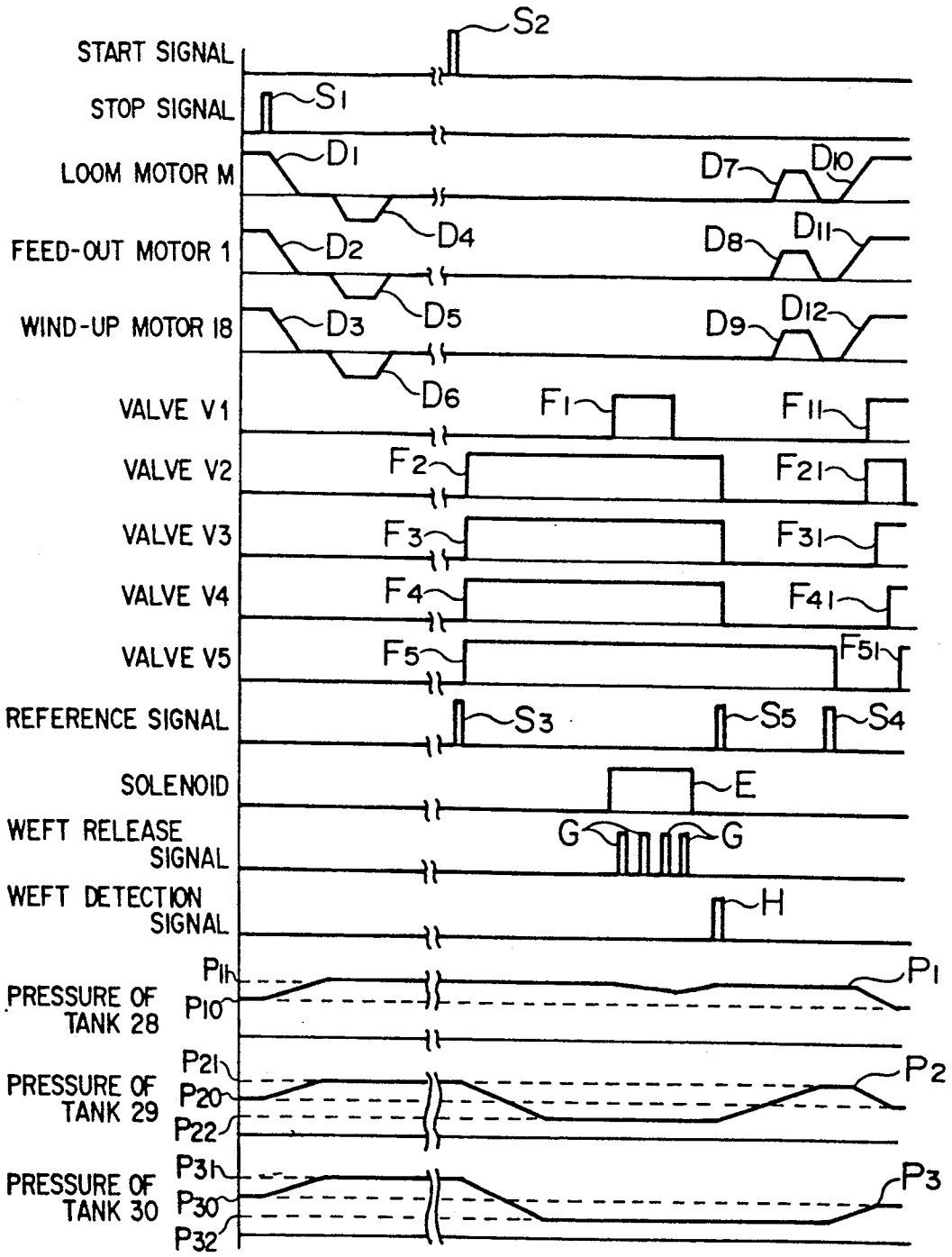
FIG. 19 is a view for graphically illustrating pressure control and energization/deenergization control for the one-shot weft insertion process performed by the weaving bar generation preventing apparatus shown in FIG. 10.

In FIG. 19, a curve E represents the one-shot energization/deenergization of the electromagnetic solenoid 26 while curves $F_1$ and $F_i$ ($i=2, \ldots, 5$) represent one-shot energization/deenergizations for the electromagnetic valves $V_1$; $V_i$ ($i=2, \ldots, 5$), respectively. Further, a curve $P_1$ represents the pressure within the pressurized air supply tank 28, a curve $P_2$ represents the pressure within the pressurized air supply tank 29 and a curve $P_3$ represents the pressure within the pressurized air supply tank 30. In other words, the curve $P_1$ represents the jet pressure of the weft inserting main nozzle 20, the curve $P_2$ represents the jet pressure of the auxiliary weft inserting nozzles 21 to 23, and the curve $P_3$ represents the jet pressure of the auxiliary weft inserting nozzle 24. The weft $Y_2$ undergoes the one-shot insertion, as shown in FIGS. 14 to 16, at the jet pressures represented by the curves $P_1$, $P_2$ and $P_3$ in FIG. 19 under the energization/deenergization control represented by the curves E, $F_1$ and $F_i$.

In FIG. 19, the curve G represents a weft unwinding detection signal. When the number of times the weft was unwound from the surface 19*a* as detected by the weft unwinding detector 27 has attained a preset number N, the auxiliary control computer $C_1$ deenergizes the electromagnetic solenoid 26. As a consequence of this deeenergization, the retaining pin 26*a* engages the weft winding surface 19*a* to thereby prevent the weft from being further unwound therefrom.

By inhibiting the weft from being unwound from the weft winding surface 19*a*, the weft insertion is completed. In this conjunction, it is noted that shock to which the weft is subjected upon stoppage of the weft unwinding may provide a cause for weft breakage, which is more likely to take place as the final weft running speed is higher. The jets produced by the auxiliary weft inserting nozzles 21 to 25 in the course of the weaving operation are to serve for maintaining the speed at which the weft is ejected from the weft inserting main nozzle 20. On the other hand, the weft flying or running speed during the weaving operation is determined primarily by the initial speed at which the weft is ejected from the main nozzle 20. Accordingly, as the initial speed is higher, the final running speed becomes higher, to increase the possibility of weft breakage. The weft flying speed in the weaving operation is set in a range in which no weft breakage can occur, wherein the weft flying or running speed is determined primarily by the pressures within the pressurized air tanks 28, 29 and 30.

Due to pressure characteristics of the pressure control valves 33, 34 and 35, the pressures prevailing within the pressurized air supply tanks 28, 29 and 30 when the weaving is stopped become higher as compared with the pressures prevailing within these tanks during the weaving operation. In this conjunction, pressures $P_{10}$, $P_{20}$ and $P_{30}$ shown in FIG. 19 represent the pressures prevailing within the pressurized air supply tanks 28, 29 and 30, respectively, when the weaving operation is carried out, while pressures $P_{11}$, $P_{21}$ and $P_{31}$ represent the pressures within the tanks 28, 29 and 30 in the weaving operation suspended state. Due to the pressure characteristics such as illustrated in FIG. 19, operations of the weft inserting main nozzle 20 and the auxiliary weft inserting nozzles 21 to 24 at the jet timing for the weaving operation cause the weft $Y_2$ to be subjected to the jet pressures $P_{11}$, $P_{21}$ and $P_{31}$ which are higher than the pressures $P_{10}$, $P_{20}$ and $P_{30}$, resulting in that the weft running speed at the one-shot weft insertion becomes higher when compared with the speed during the weaving operation. For this reason, upon completion of the one-shot weft insertion, an excessive shock produced by stopping the unwinding of the weft from the weft winding surface 19*a* is applied to the weft, which is thus more likely to be broken.

For solving the problem described above, it is taught according to an aspect of the present invention residing in the instant embodiment that the auxiliary weft inserting nozzles 21 to 24 are operated to produce air jets for a predetermined period t before the weft inserting main nozzle 20 is put into operation. Through these preliminary jet operations, the jet pressures of the auxiliary weft inserting nozzles 21 to 24 are lowered. Although the extent to which the pressures within the pressurized air supply tanks 29 and 30 are lowered depends on the capacities of these tanks, the preliminary jet period t mentioned above can be so set that the pressures within the pressurized air supply tanks 29 and 30 are lowered to the pressure levels $P_{22}$ and $P_{32}$ shown in FIG. 19 which represent the lowest pressures when the air flow rates are at maximum. Jet operations of the auxiliary weft inserting nozzles 21 to 24 are performed intermittently during the weaving operation of the loom, and the lowest pressures $P_{22}$ and $P_{32}$ in the continuous jet operation mode are lower than the pressures $P_{20}$ and $P_{30}$ in the intermittent jet operation. Thus, although the weft $Y_2$ is ejected from the weft inserting main nozzle 20 at a higher jet pressure $P_{11}$ than the pressure $P_{10}$ in the weaving operation, the weft is subsequently subjected to a tractive effort of the lower jet pressures $P_{22}$ and $P_{32}$ than the pressures $P_{20}$ and $P_{30}$ in the normal weaving operation. To say in another way, in the one-shot weft insertion, the initial speed of the weft $Y_2$ as inserted is certainly high. However, the weft flying or running speed is decreased lower than the speed in the normal weaving operation, whereby the weft breakage due to shock produced upon stopping of the weft unwinding from the weft winding surface 19*a* can positively be prevented.

When the weft $Y_2$ inserted through the one-shot insertion process described above is detected by the weft detector 25, the main control computer $C_0$ responds to a weft detection signal H outputted from the weft detector 25 by supplying a reference signal $S_5$ to the auxiliary control computer $C_2$ which in turn responds to the reference signal $S_5$ by deenergizing the electromagnetic valves $V_2$, $V_3$ and $V_4$. The weft $Y_2$ to be beaten upon restarting of the weaving operation is first placed under a tension applied owing to the jet produced by the auxiliary weft inserting nozzle 24. As indicated by the arrow R in FIG. 16, the weft $Y_2$ inserted through the one-shot weft insertion process is maintained in an attitude favorable to the beating within a weft insertion passage 6*a* of the modified reed 6 under the tension mentioned above. In this manner, the weft $Y_2$ is protected against being beaten in a slack state which is likely to give rise to a fault in the woven fabric. Of course, there can also be avoided such situation that the weft $Y_2$ is displaced from the weft insertion passage 6*a*.

After the electromagnetic valves $V_2$, $V_3$ and $V_4$ having been deenergized, the main control computer $C_0$ issues a command for rotating at a low speed the loom motor M, the feed-out motor 1 and the winding motor 18 in synchronism with one another, as indicated by curves $D_7$, $D_8$ and $D_9$, respectively, in FIG. 19. Through this synchronous slow forward rotations of the motors M, 1 and 18, the modified reed 6 is moved from the position shown in FIG. 17 to the position shown in FIG. 18 which is appropriate for the restart of the weaving operation. This appropriate position corresponds to the position taken by the reed 6 immediately before the beating. Accordingly, by causing the modified reed 6 to swing for the beating, the first weft insertion as well as the beating upon restart of the weaving operation can smoothly be performed. It should be mentioned that during the slow forward rotation mentioned above, the modified reed 6 does not pass through the beating position and the cloth fell $W_1$ is not beaten by the modified reed 6.

Figure 17:
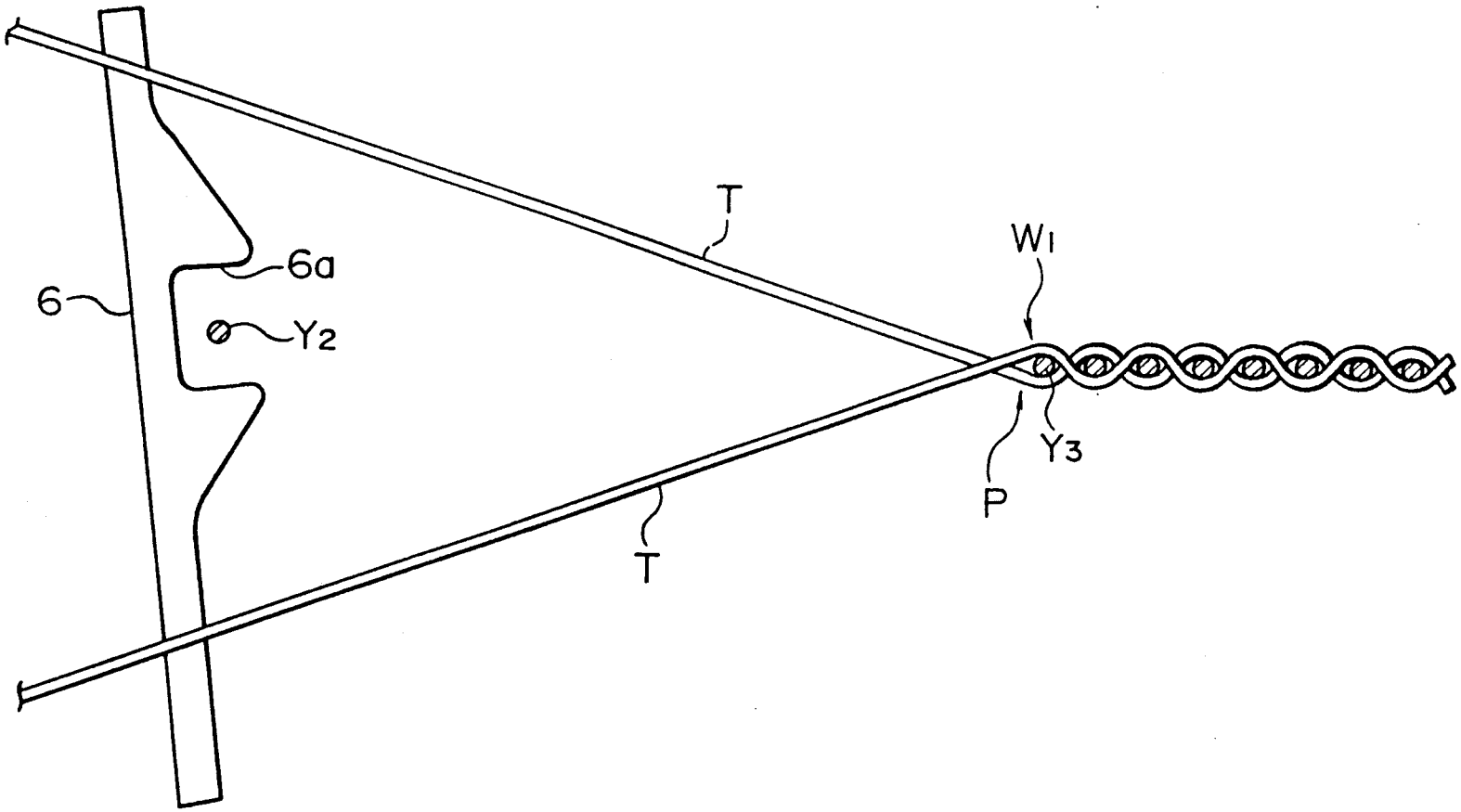
FIG. 17 is an enlarged side elevational view around the cloth fell for illustrating the one-shot weft insertion process.

Assuming that no fresh weft $Y_2$ is inserted through the one-shot weft insertion process to replace the failure suffering weft $Y_1$ as removed (i.e. assuming that the weft $Y_2$ shown in FIG. 17 is spared), it is required to draw back the weft $Y_3$ inserted before the failure suffering weft $Y_1$ to the beating position P in order to allow the modified reed 6 to be moved to the position suited for restarting the weaving operation. To this end, the loom has to be revolved reversely to the position before the weft $Y_3$ was beaten, which is accompanied with the move of the modified reed passing through the beating position P. As a consequence, the cloth fell $W_1$ will be beaten by the modified reed 6 during the slow reverse revolution of the loom to the weaving restarting position, producing a wavy set mark, unless the fresh weft $Y_2$ is inserted through the one-shot weft insertion process described above.

In contrast, by inserting the weft $Y_2$ by one shot in place of the failure suffering weft $Y_1$, it is sufficient to move the weft $Y_2$ inserted to the beating position P upon restarting the weaving operation. In this case, since the loom is rotated forwardly at a low speed and because the position assumed by the loom before the beating corresponds to the weaving restart position, the modified reed 6 does not pass through the beating position P. Accordingly, the cloth fell $W_1$ is never beaten by the modified reed 6, giving rise to no generation of the wavy set mark.

Parenthetically, the weaving restart position can be set rather arbitrarily. To this end, the loom may be revolved in the forward or reverse (backward) direction. Besides, it is equally possible to restart the loom motion from the position where the one-shot weft insertion has been performed. Further, the amount of revolution of the loom either in the forward or reverse direction may be set without restriction. In any case, the loom (weaving) restart position can be established such that the modified reed 6 need not pass through the beating position P.

Figure 18:
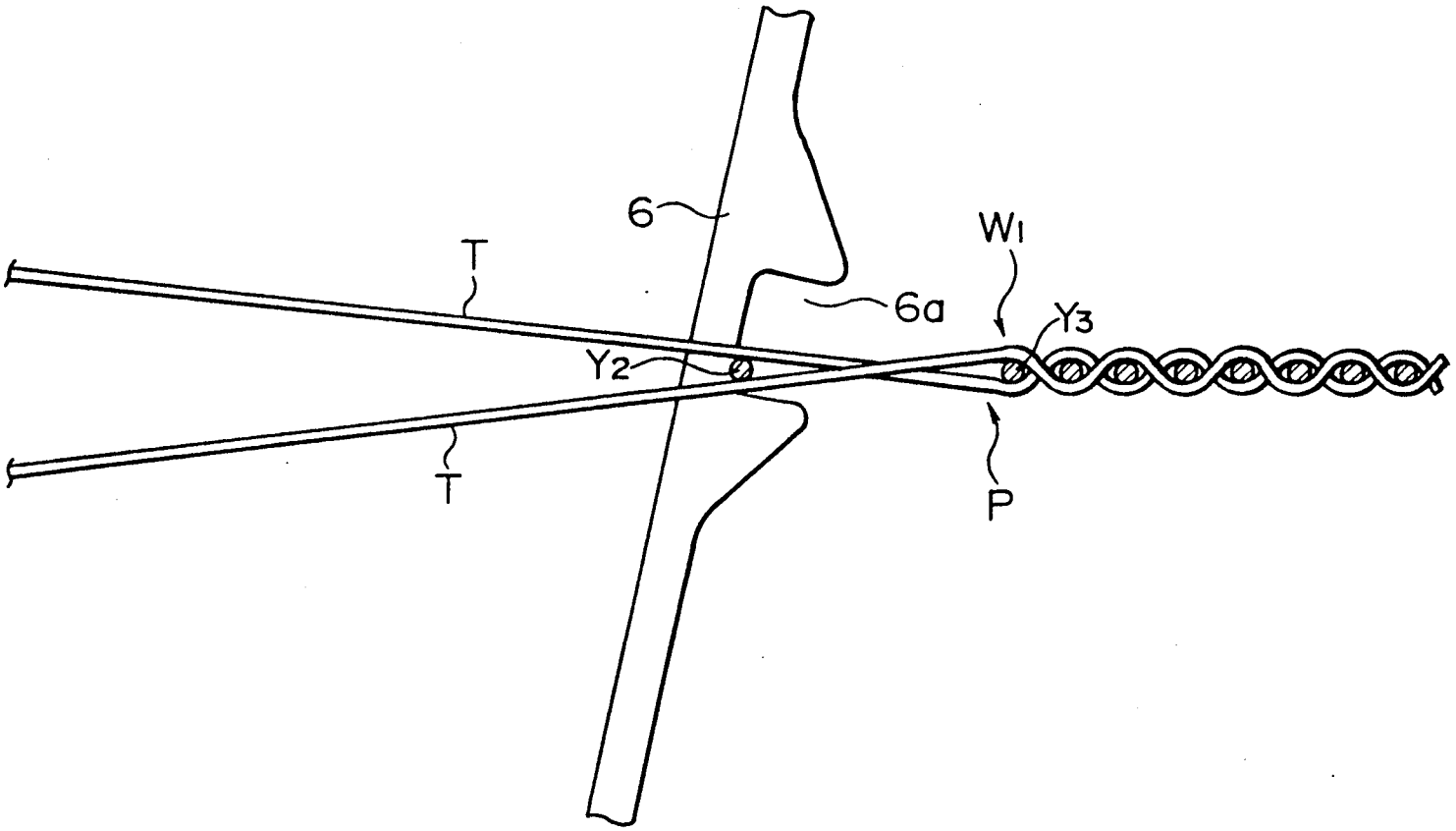
FIG. 18 is an enlarged side elevational view around the cloth fell for illustrating a modified reed that is moved to a position for restarting the weaving operation.

When the modified reed 6 has been displaced to the weaving restart position shown in FIG. 18, the main control computer $C_0$ outputs a one-shot weft insertion ending (terminating) reference signal $S_4$ to the auxiliary control computer $C_1$ and $C_2$.

The auxiliary control computer $C_1$ responds to the reference signal $S_4$ to effect the energization/deenergization control of a solenoid 26 for the weaving operation. On the other hand, the auxiliary control computer $C_2$ responds to the one-shot weft insertion end reference signal $S_4$ as inputted for thereby deenergizing the electromagnetic valve $V_5$ and performs the relay energization/deenergization control of the electromagnetic valves $V_1$ to $V_5$, as indicated by the curves $F_{11}$, $F_{21}$, $F_{31}$, $F_{41}$ and $F_{51}$, respectively. The main control computer $C_0$ commands the start of the synchronous forward rotations of the loom motor M, the feed-out motor 1 and the wind-up motor 18, as indicated by curves $D_{10}$, $D_{11}$ and $D_{12}$, respectively, in FIG. 19, whereby the weaving operation or loom motion is restarted.

At this juncture, it is admitted that a one-shot weft insertion activation prior to the restart of weaving operation of a jet loom is disclosed in JP-A-58-197350. However, with this known one-shot weft insertion process, it is aimed to restart the weaving operation smoothly by suppressing troubles which will otherwise accompany the weft insertion upon restart of the weaving operation, and there can be found in the abovementioned publication neither teaching nor suggestion as to the prevention of generation of the wavy set mark.

Figure 20:
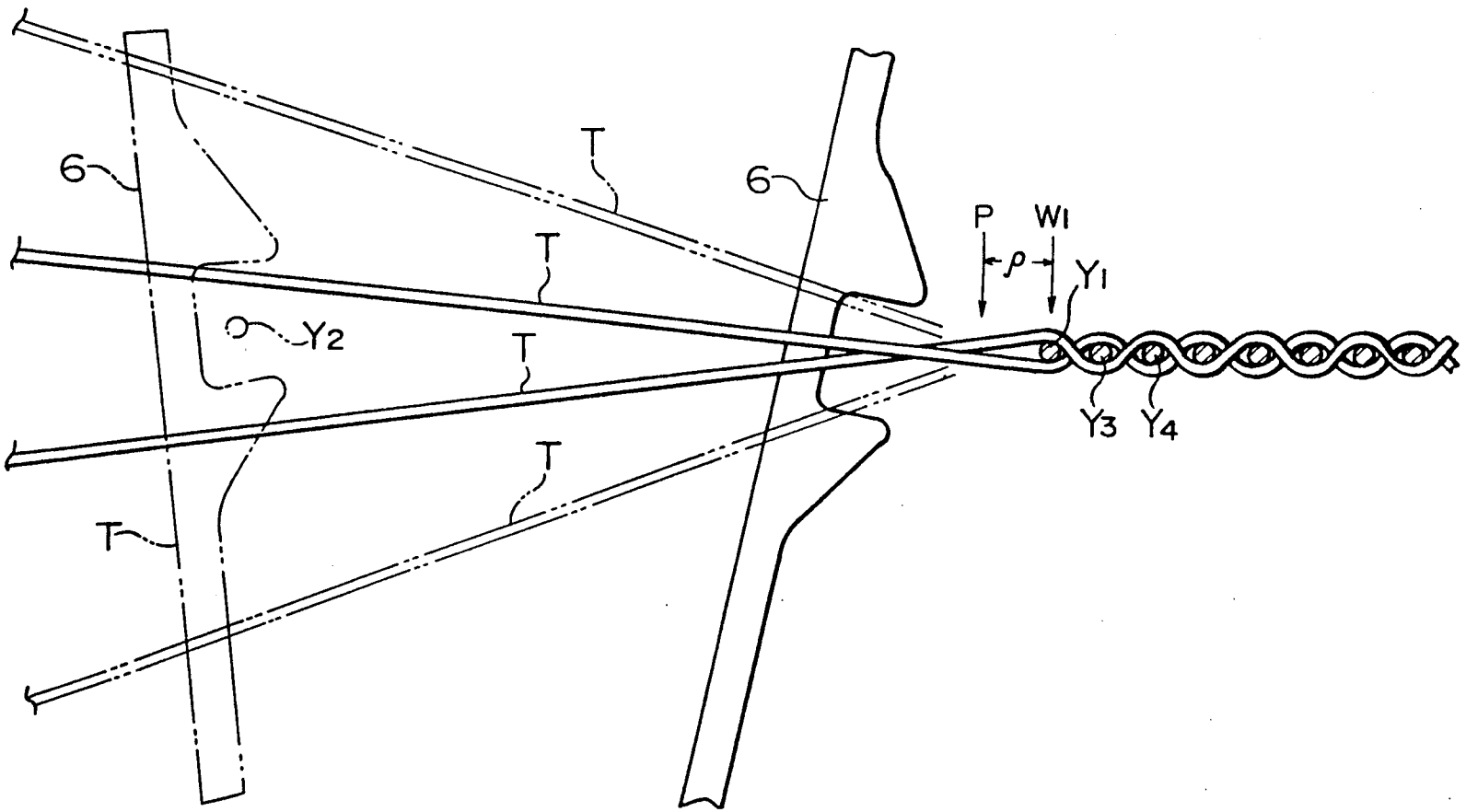
FIG. 20 is an enlarged side elevational view for illustrating displacement of the cloth fell in the apparatus according to a modification of the third embodiment shown in FIGS. 10 and 11.
Figure 21:
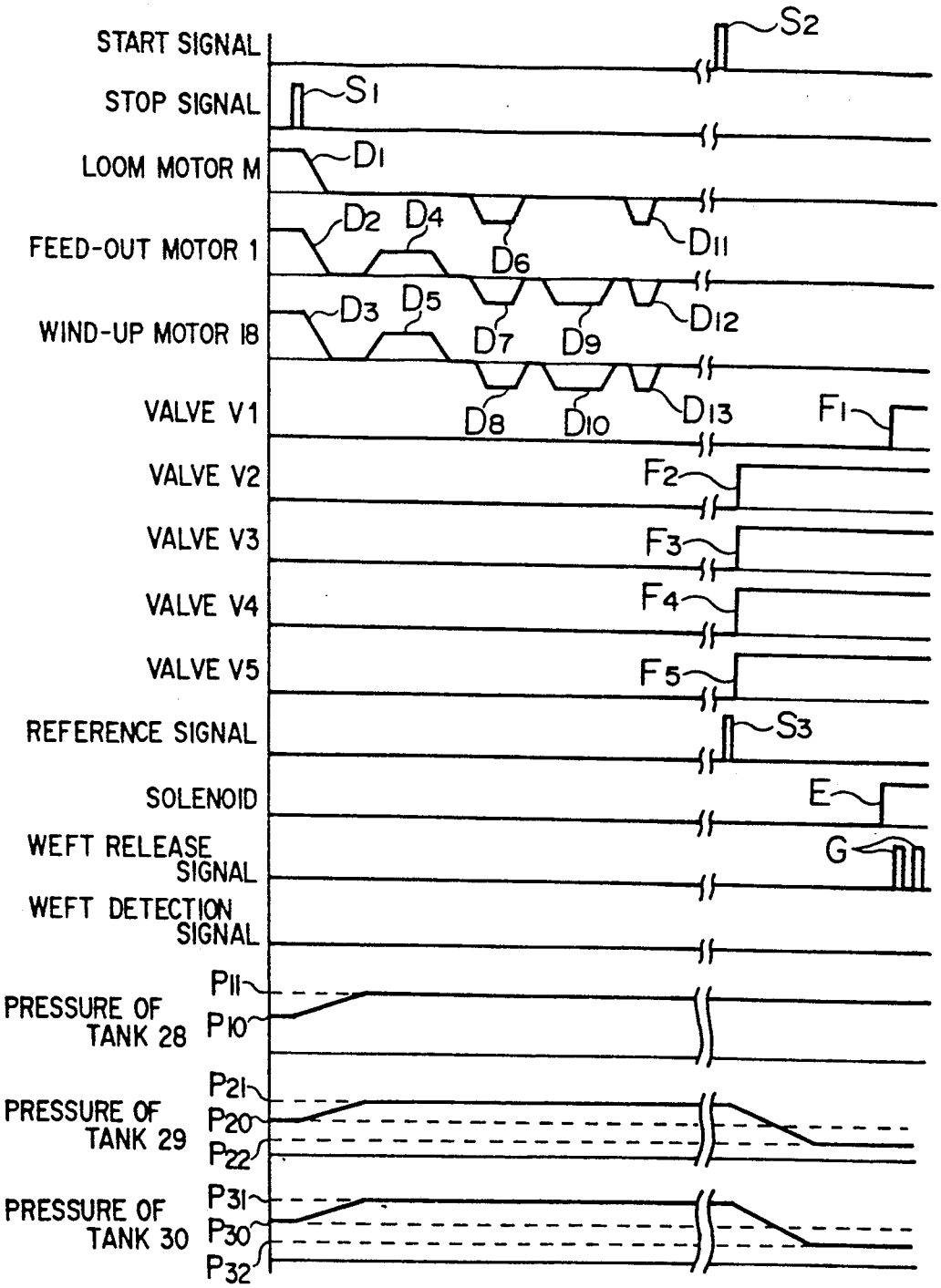
FIG. 21 is a view for graphically illustrating the pressure control and the energization/deenergization control for the one-shot weft insertion process in the apparatus according to the third embodiment of the invention.

FIGS. 20 and 21 show a modification of the embodiment described above. Although the general hardware arrangement and the control functions of the auxiliary control computers $C_1$ and $C_2$ are similar to those described above in conjunction with the preceding embodiment, the control function of the main control computer $C_0$ differs with regard to some respects, which will be described below.

When a weft insertion failure takes place, the motors M, 1 and 18 are stopped in synchronism with one another, as indicated by curves $D_1$, $D_2$ and $D_3$ in FIG. 21, whereby the modified reed 6 is caused to stop at a position immediately before the beating position. After the loom has been stopped, the main control computer $C_0$ commands the feed-out motor 1 to perform a slow forward rotation by a predetermined amount (angular distance) $Q^+$ set through the input unit 31 as indicated by the curve $D_4$ while commanding the wind-up motor 18 to rotate slowly in the forward direction by a predetermined amount $R^+$ set through the input unit 31. In other words, prior to the slow reverse rotation of the loom motor M by a predetermined amount for the weft insertion failure processing, there are carried out the slow forward rotation of the feed-out motor 1 by the predetermined amount $Q^+$ and the slow forward rotation of the wind-up motor 18 by the predetermined amount $R^+$. Owing to these slow forward rotations of both motors 1 and 18, the warps T are fed out by a predetermined amount or length $\rho$, while the cloth W is slowly wound up by the predetermined amount (length) $\rho$, as a result of which the cloth fell $W_1$ is moved toward the cloth W from the normal position by the predetermined amount (distance) $\rho$, as illustrated in FIG. 20.

After the slow forward rotations of the feed-out motor 1 and the wind-up motor 18 by the predetermined amount (rotation angle), respectively, the loom motor M is rotated slowly in the reverse (backward) direction to thereby revolve slowly the loom about one and a half rotation, as indicated by the curve $D_6$ in FIG. 21. As a result of this slow reverse revolution, the modified reed 6 is caused to move from the position indicated by a solid line in FIG. 20 to a most retracted position indicated by a dash line, to thereby allow the opening to be formed between the warps T to a maximum extent. Thus, the failure suffering weft $Y_1$ on the cloth fell $W_1$ is released from the gripping action of the warps T, making it possible to perform the processing for remedying or eliminating the weft insertion failure now of concern. Incidentally, the feed-out motor 1 and the wind-up motor 18 are slowly rotated in the reverse direction in synchronism with the slow reverse rotation of the loom motor M, as indicated by curves $D_7$ and $D_8$.

After formation of the maximum opening between the warps, the feed-out motor 1 is slowly rotated in the reverse direction by the predetermined amount $Q^-$, as indicated by a curve $D_9$ in FIG. 21 with the wind-up motor 18 being slowly rotated in the reverse direction by a predetermined amount $R^-$ in synchronism with the wind-up motor 18, as indicated by the curve $D_{10}$. As a result of the synchronous slow reverse rotations of the motors 1 and 18, the warp T are slowly withdrawn by a predetermined amount (length) $\rho$ with the cloth W being slowly wound by the predetermined amount $\rho$, resulting in that the cloth fell $W_1$ returns to the normal position P.

After the cloth fell $W_1$ has resumed the normal position P, the failure suffering weft $Y_1$ is removed, whereon the one-shot insertion of a fresh weft $Y_2$ and the weaving restart processing are executed, as in the case of the preceding embodiment. As described hereinbefore, during the slow reverse revolution of the loom about one and a half rotation for the purpose of eliminating the weft insertion failure, the modified reed 6 moves from a stop position indicated by the solid line in FIG. 20 to the most retracted position indicated by the broken line while passing through the normal reed position (beating position) P. Accordingly, if the cloth fell $W_1$ lies at the beating position P, it will be beaten by the modified reed 6. However, since the cloth fell $W_1$ is retracted in the uptake direction of the cloth W from the beating position P prior to the slow reverse rotation of the loom for the purpose of the weft insertion failure elimination processing, as described above, the cloth fell $W_1$ is never beaten by the modified reed 6. Consequently, wefts $Y_3$, $Y_4$ and others inserted prior to the weft $Y_1$ are protected against displacement in the direction thicknesswise of the cloth W, producing no wavy set mark ascribable to the displacement of these wefts $Y_3$ and $Y_4$. Thus, according to the instant embodiment, generation of a wavy set mark can be prevented more positively than in the case of the preceding embodiment.

Figure 22:
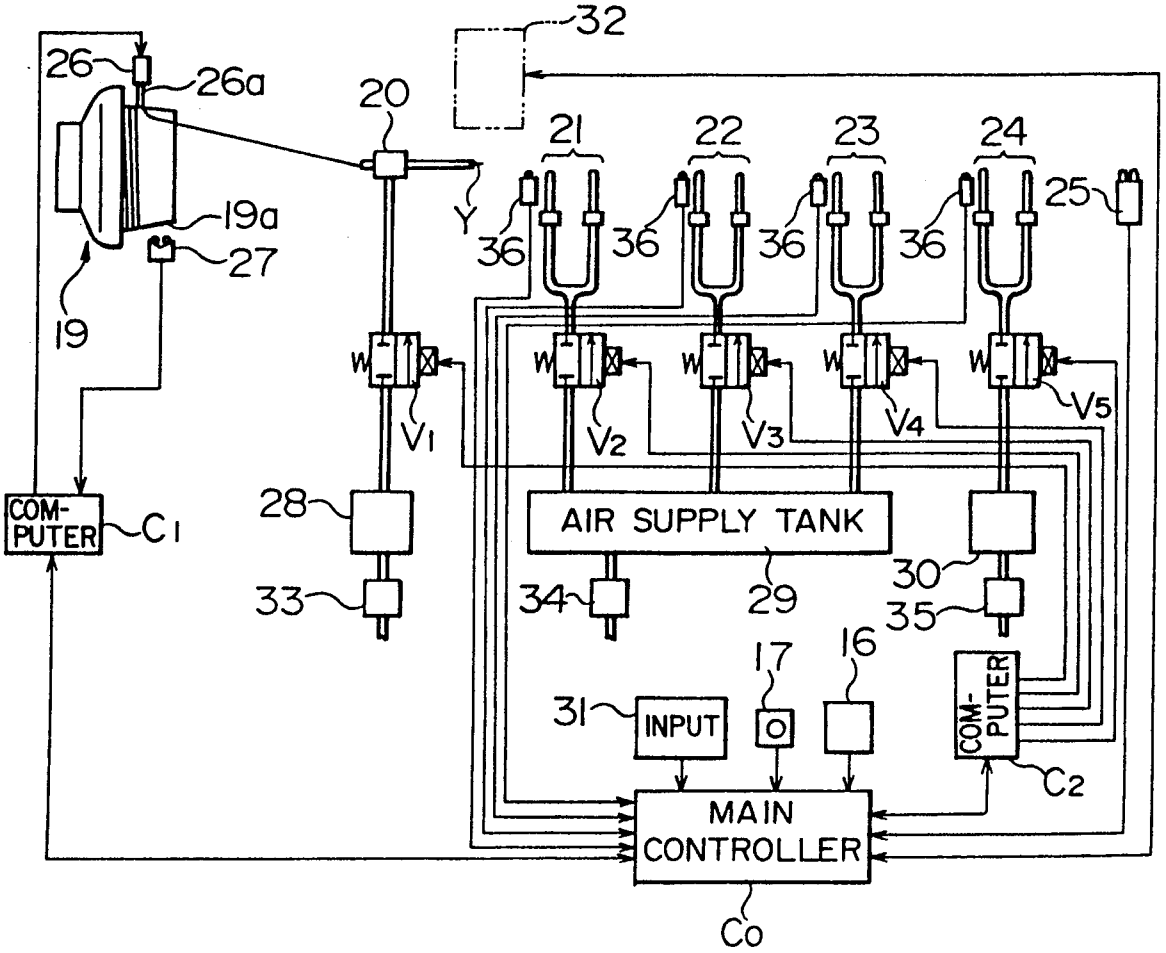
FIG. 22 is a schematic diagram showing a weaving bar generation preventing apparatus according to another modification of the third embodiment shown in FIGS. 10 and 11.
Figure 23:
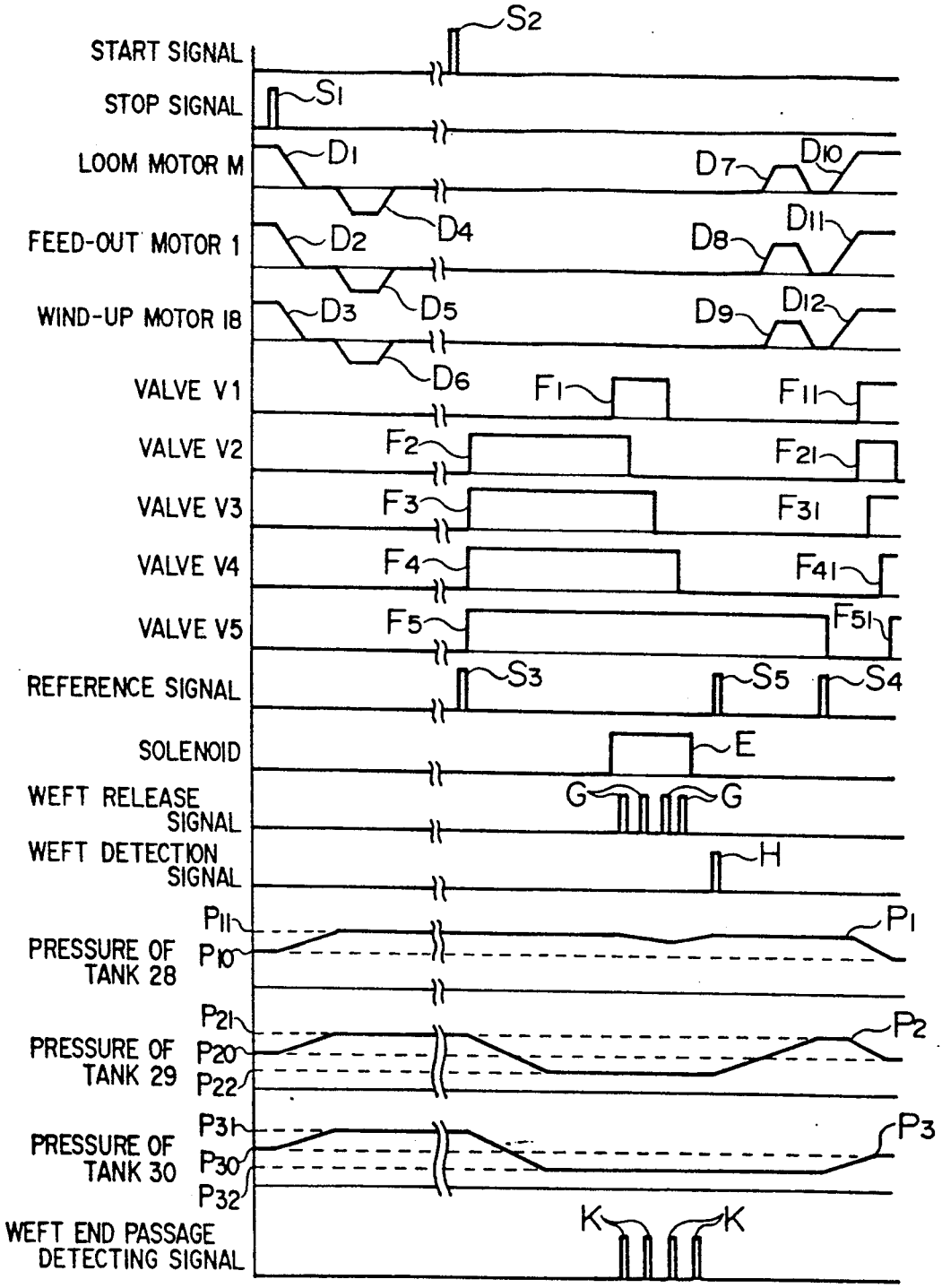
FIG. 23 is a view for graphically illustrating a pressure control and energization/deenergization control for a one-shot weft insertion process performed by the weaving bar generation preventing apparatus shown in FIG. 22.

According to another modified embodiment of the invention, a plurality of weft end pass detectors 36 may be disposed along a weft running or flying path as shown in FIG. 22, whereby the electromagnetic valves $V_2$ to $V_4$ may be deenergized under the timing at which weft end detection signals K are outputted from the individual weft end pass detectors 36 as shown in FIG. 23. By virtue of this type electromagnetic valve deenergization control, the auxiliary weft inserting nozzle groups 21 to 23 stop successively ejections of the air jet as the weft end passes by successively the weft end detectors, whereby the weft running speed can be further lowered, ensuring more positive protection against breakage of the weft.

Further, according to the invention, the deenergization timing of the solenoid 26 and the electromagnetic valves $V_2$ to $V_5$ can be determined on the basis of the detection information available from the output of the weft unwinding detector 25. Furthermore, the invention can be applied not only to the prevention of generation of a wavy set mark but also to the one-shot weft insertion for avoiding weft insertion trouble upon restart of the loom, as is disclosed in JP-A-58-197350.

In the case of a loom in which a weft missing preventing fluid channel or path is connected to the weft inserting main nozzle separately from the ordinary weft inserting fluid path, it is possible according to the invention to effectuate the one-shot weft insertion by making use of the weft missing preventing fluid path.

Figure 24:
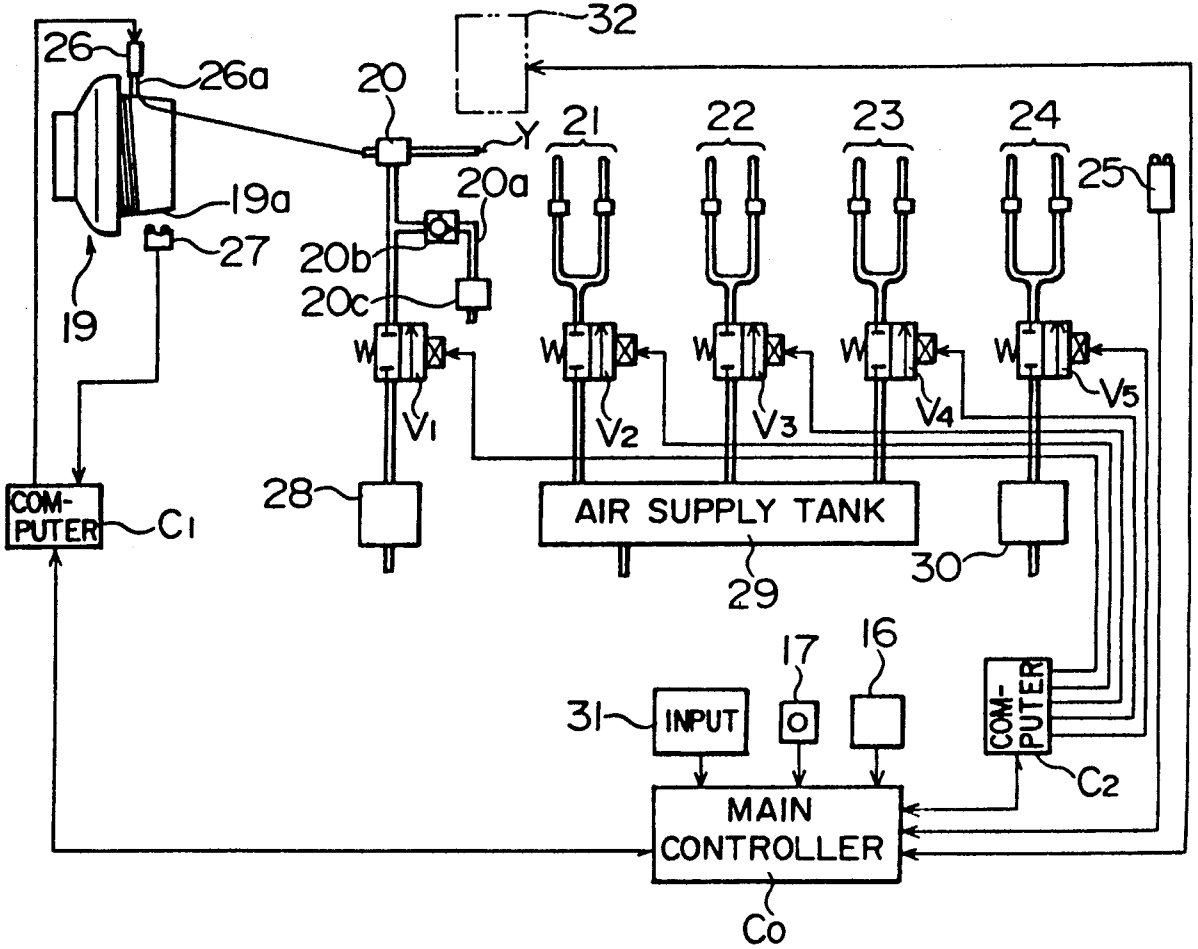
FIG. 24 is a schematic diagram showing a weaving bar generation preventing apparatus according to a further modification of the third embodiment of the invention shown in FIGS. 10 and 11.

More specifically, referring to FIG. 24, descripting will be made of the arrangement which differs from the structure shown in FIG. 10. Connected to the weft inserting main nozzle 20 is a breeze pipe 20*a* having a check valve 20*b* disposed therein and connected to a pressure supply source (not shown) through a pressure regulator 20*c* which serves to regulate the pressure within the breeze pipe 20*a* at a level lower than that within the pressurized air supply tank 28. Accordingly, the air is constantly supplied to the breeze pipe 20*a* at a pressure lower than that of the pressurized air supply tank 28, as a result of which the weft inserting main nozzle 20 ejects the breeze except for the period during which the weft inserting air jet is produced. The breeze jet is effective for preventing the weft from missing from the weft inserting main nozzle 20. This weft missing preventing operation is maintained even in the state where the weaving operation is suspended.

In the case of the third embodiment described hereinbefore by reference to FIGS. 10 to 23, the auxiliary weft inserting nozzles are first operated to produce the jets simultaneously, wherein one weft is ejected and inserted from the weft inserting main nozzle upon starting of the weaving operation. It should however be noted that generation of a weaving bar can be suppressed by inserting newly one weft in place of the removed weft through relay jets (successive jets) of the weft inserting main nozzle and the auxiliary weft inserting nozzles according to a fourth embodiment of the invention.

Figure 25:
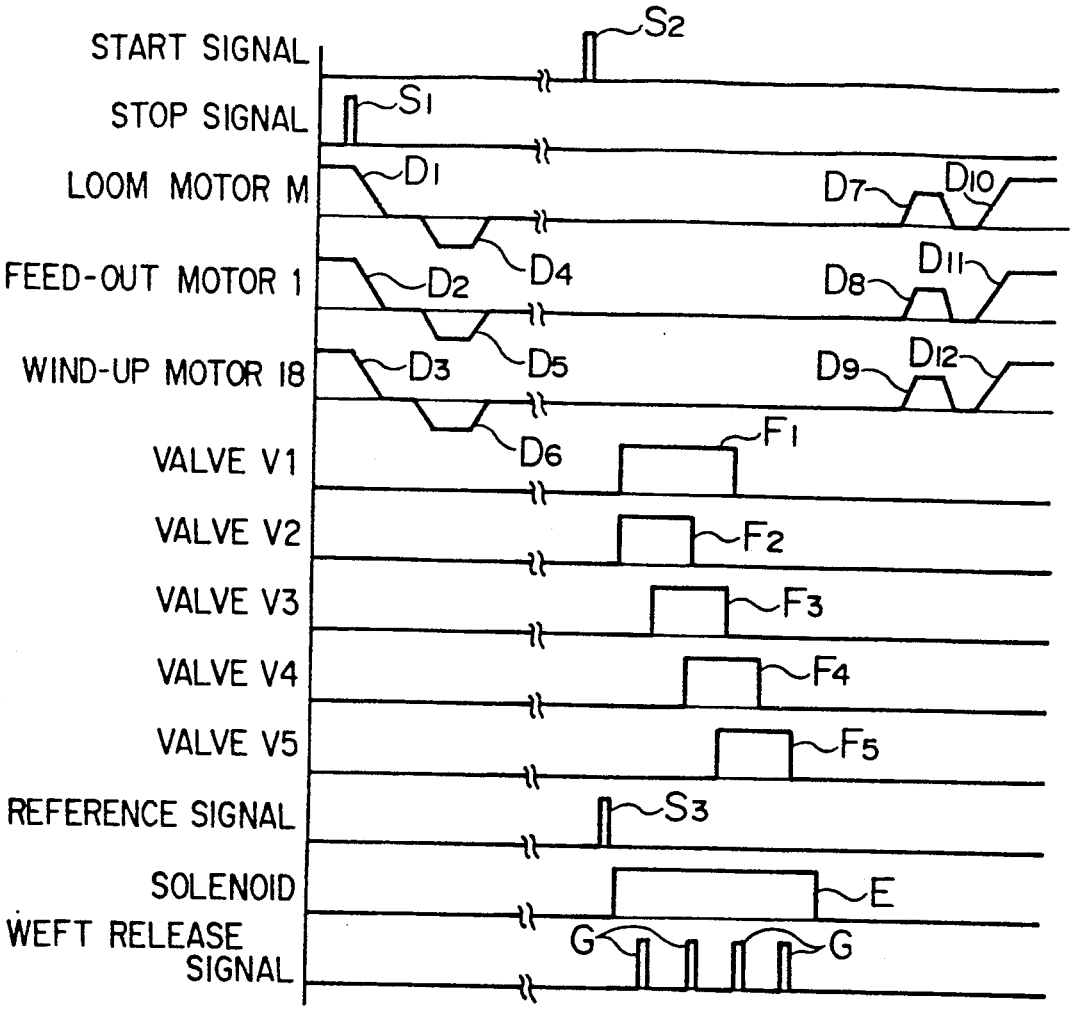
FIG. 25 is a view for graphically illustrating an energization/deenergization control for effectuating a one-shot weft insertion in a weaving bar generation preventing method and apparatus according to a fourth embodiment of the present invention.
Figure 26:
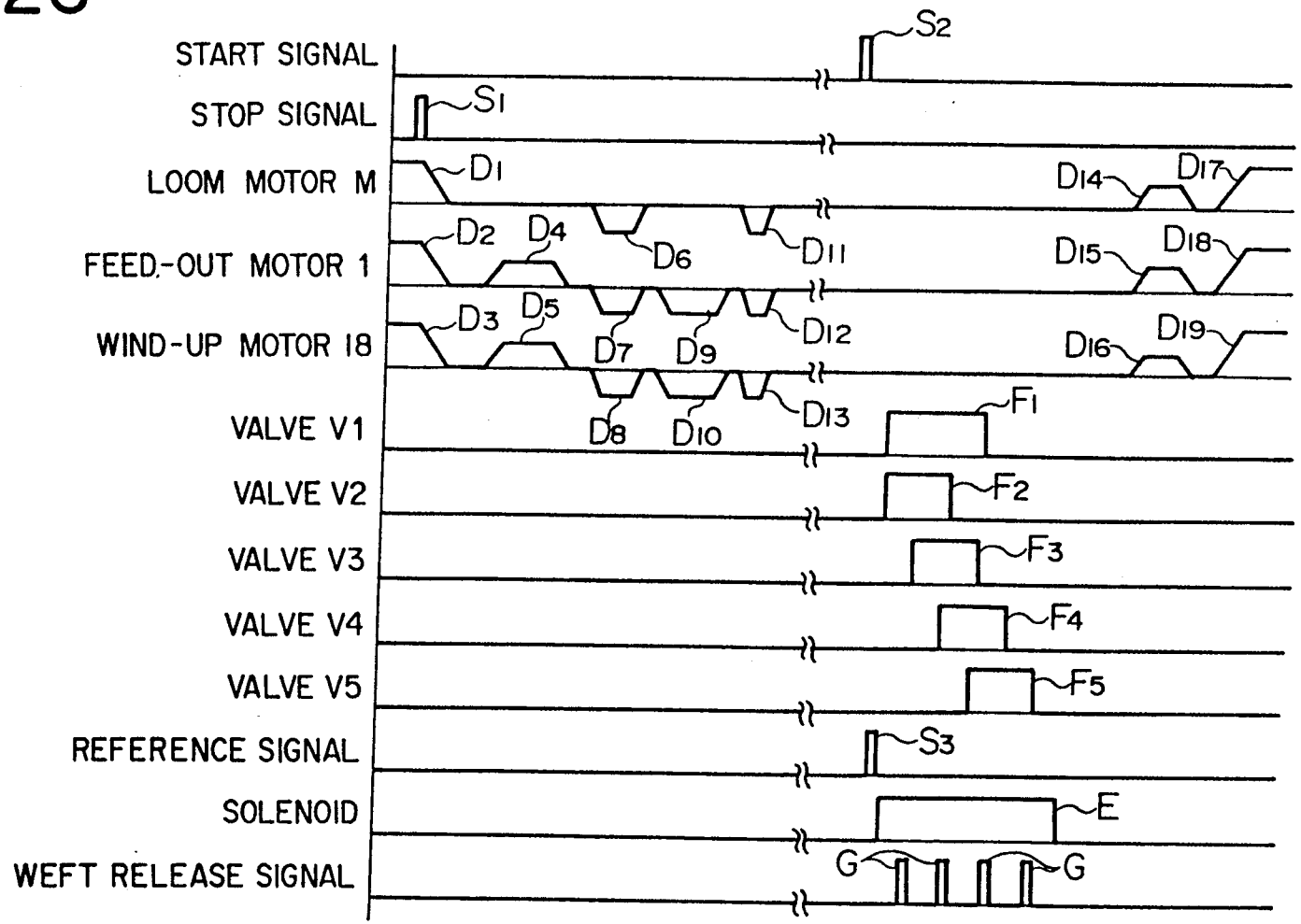
FIG. 26 is a view for graphically illustrating an energization/deenergization control for the one-shot weft insertion according to a modification of the embodiment shown in FIG. 25.

Next, description will be directed to the fourth embodiment by reference to FIGS. 25 and 26. However, the illustrations of FIGS. 10–13 and FIGS. 17, 18 and 22 as well as descriptions made of the third embodiment by reference to these figures can also be applied to the fourth embodiment. Accordingly, for those parts which are not designated by reference symbols in FIGS. 25 and 26, reference should be made to the figures relating to the third embodiment.

Now, description will be directed to the weaving bar generation preventing control according to the fourth embodiment by reference to the graph shown in FIG. 25.

Upon occurrence of a weft insertion failure, the main control computer $C_0$ responds to an abnormality detection signal outputted from the weft detector 25 by issuing a command for stopping the operations of the loom motor M, the feed-out motor 1 and the wind-up motor 18. The motors M, 1 and 18 are stopped synchronously with one another, as indicated by curves $D_1$, $D_2$ and $D_3$ shown in FIG. 25, respectively, resulting in that the warp feeding operation and the cloth winding operation are stopped with the modified reed 6 also stopping at a position immediately before the beating position (FIG. 12). The signal $S_1$ shown in FIG. 25 is a weaving stop signal.

When a weft insertion failure takes place, the weft processing apparatus 32 is actuated to prevent a weft succeeding to the failure weft $Y_1$ from being inserted before the motors M, 1 and 18 assume the stationary state.

After having been stopped, the motor M, 1 and 18 are rotated in the reverse (backward) direction, as indicated by curves $D_4$, $D_5$ and $D_6$, respectively. During this slow reverse rotation, the loom is revolved about one and a half rotation in the reverse or backward direction to allow a maximum opening span to be formed between the warps T (FIG. 13). As a result of this, the failure weft $Y_1$ on the cloth fell $W_1$ is released from the gripping action exerted by the warps T, whereupon the failure weft $Y_1$ is pulled out laterally of the warp opening and removed from the cloth fell $W_1$ through the withdrawal operation performed by the weft processing apparatus 32 by tracing up the succeeding weft.

The modified reed 6 passes through the normal position P of the cloth fell $W_1$, i.e. the beating position P, before the cloth fell $W_1$ could be moved from the position shown in FIG. 12 to the position shown in FIG. 13. Accordingly, the failure suffering weft $Y_1$ on the cloth fell $W_1$ would be beaten by the modified reed 6 to be dislocated in the direction thicknesswise of the woven fabric, generating a wavy set mark. However, since the failure suffering weft $Y_1$ has been pulled outwardly and removed by the weft processing apparatus 32, as mentioned above, the failure weft $Y_1$ will not provide a cause for generation of a wavy set mark.

Through the synchronized slow reverse rotations of the motors M, 1 and 18, the warps T are withdrawn at a low speed with the cloth W being unwound slowly. Since the amounts of the slow withdrawal and the slow unwinding are identical with each other, the cloth fell $W_1$ undergoes displacement corresponding to the amount of the slow reverse revolution of the loom.

Upon completion of the processing for eliminating the weft insertion failure, the main control computer $C_0$ is ready for receiving the start signal $S_2$. Thus, in response to the input start signal $S_2$ produced by turning on the start switch 17, the main control computer $C_0$ outputs a reference signal $S_3$, for starting the one-shot weft inserting operation, to the auxiliary control computers $C_1$ and $C_2$.

The auxiliary control computer $C_2$ responds to the weaving stop signal $S_1$ supplied from the main control computer $C_0$ to thereby stop the energization/deenergization control of the electromagnetic valves $V_1$; $V_i$ ($i=2, \ldots, 5$). In response to the reference signal $S_3$, the auxiliary control computer $C_2$ performs a control for effecting the one-shot relay energization/deenergization of the electromagnetic valves $V_1$ and $V_i$ at predetermined timings.

On the other hand, the auxiliary control computer $C_1$ responds to the weaving stop signal $S_1$ supplied from the main control computer $C_0$ by stopping the energization/deenergization control of the solenoid 26 and assumes the state ready for receiving the reference signal $S_3$. Upon inputting of the reference signal $S_3$, the auxiliary control computer $C_2$ energizes the solenoid 26 at a predetermined time interval. As a result of this, the retaining pin 26*a* is caused to disengage from the weft winding surface 19*a*, allowing the weft to be unwound and led outwardly from the weft winding surface 19*a*.

In FIG. 25, the curve E represents the one-shot energization/deenergization of the solenoid 26 while curves $F_1$ and $F_1$ ($i=2, \ldots, 5$) represent one-shot energization/deenergization of the electromagnetic valves $V_1$; $V_1$, respectively. Through the energization/-deenergization control indicated by curves E, $F_1$ and $F_1$ shown in FIG. 25, a weft $Y_2$ undergoes the one-shot weft insertion.

In FIG. 25, the curve G represents a weft unwinding detection signal. When the number of times the weft was unwound from the surface 19*a* as detected by the weft unwinding detector 27 has attained a preset number N, the auxiliary control computer $C_1$ deenergizes the electromagnetic solenoid 26 after lapse of a predetermined time. As a consequence of this deeenergization, the retaining pin 26*a* is caused to engage the weft winding surface 19*a* to prevent the weft from being further unwound therefrom.

When the weft $Y_2$ having undergone the one-shot weft inserting operation is detected by the weft detector 25, the main control computer $C_0$ responds to the detection signal outputted from the detector 25 by rotating slowly in the forward direction the loom motor M, the feed-out motor 1 and the wind-up motor 18 in synchronism with one another, as indicated by curves $D_7$, $D_8$ and $D_9$ shown in FIG. 25, respectively. Through this synchronous slow forward rotations of the motors M, 1 and 18, the modified reed 6 is moved from the position shown in FIG. 17 to the position shown in FIG. 18 which is suited for the restart of the weaving operation. This restart position corresponds to the position occupied by the reed 6 immediately before the beating. Accordingly, by causing the modified reed 6 to swing for the beating, the first weft insertion as well as the beating upon restart of the weaving operation can smoothly be performed. It should be mentioned that during the slow forward rotation phase mentioned above, the modified reed 6 does not pass through the beating position. Thus, the cloth fell $W_1$ is not beaten by the modified reed 6.

Assuming that no fresh weft $Y_2$ is inserted through the one-shot weft insertion process to replace the failure suffering weft $Y_1$ as removed (i.e. assuming that the weft $Y_2$ shown in FIG. 17 is absent), it is required to draw back the weft $Y_3$ inserted before the insertion of the failure suffering weft $Y_1$ to the beating position P in order to allow the modified reed 6 to be moved to the position suited for restarting the weaving operation. To this end, the loom has to be revolved reversely to the position before the weft $Y_3$ is beaten, which is accompanied with the motion of the modified reed passing through the beating position P. As a consequence, the cloth fell $W_1$ will be beaten by the modified reed 6 during the slow reverse rotation of the loom to the weaving restarting position, producing a twill pillow, unless the fresh weft $Y_2$ is inserted through the one-shot weft insertion process.

In contrast, by inserting the weft $Y_2$ by the one-shot process to replace the failure suffering weft $Y_1$, it is sufficient to move the weft $Y_2$ inserted by one shot to the beating position P upon restarting the weaving operation. In this case, since the loom is rotated forwardly at a low speed and because the position assumed by the loom before the beating operation corresponds to the weaving restarting position, the modified reed 6 does not pass through the beating position P. Accordingly, the cloth fell $W_1$ is never beaten by the modified reed 6, giving rise to no generation of the twill pillow.

Parenthetically, the loom restarting position can be set rather arbitrarily. To this end, the loom may be rotated slowly either in the forward direction or in the reverse (backward) direction. Besides, it is equally possible to restart the loom motion straightforwardly from the position where the one-shot weft insertion has been effected. Further, amount of revolution of the loom either in the forward or reverse direction may be selected rather arbitrarily. In any case, the loom (weaving) restart position can be established such that the modified reed 6 need not pass through the beating position P.

When the modified reed 6 is moved to the weaving restart position shown in FIG. 18, the loom motor M, the feedout motor 1 and the wind-up motor 18 start the forward rotations synchronously with one another, as indicated by curves $D_{10}$, $D_{11}$ and $D_{12}$ shown in FIG. 25, whereby the weaving operation is restarted.

The weft $Y_2$ to be first beaten after the restart of the weaving operation is subjected to the one-shot weft insertion under the action of the relay jets ejected by the auxiliary weft inserting nozzles 21 to 24. The relay jet ejections are effectuated in accordance with the timings at which the leading end of the weft $Y_2$ to be inserted by the one-shot process reaches the jet ejection regions of the weft insertion driving nozzles 21 to 24. More specifically, the timing for the one-shot relay energization/-deenergization of the electromagnetic valve $V_1$ is set to coincide with the time point at which the leading end of the weft $Y_2$ is expected to reach the operative region of the associated auxiliary nozzle, wherein the air jets ejected from the auxiliary nozzle groups 21 to 24 act on only the leading end of the weft $Y_2$. Although the one-shot weft insertion can be realized by simultaneous operation of the weft inserting main nozzle 20 and the auxiliary weft nozzles 21 to 24, there arises a problem that in this case the weft as inserted is subjected to a significant shock at the end of the weft insertion when the weft $Y_2$ is prevented from being unwound from the winding surface 19*a* by the retaining pin 26*a*, as a result of which the weft is likely to be broken. Such shock can however be reduced in the arrangement taught by the invention that the air jets ejected from the auxiliary weft inserting nozzles 21 to 24 act only on the leading end of the weft being inserted, as described above.

Next, description will be made of a modification of the fourth embodiment by reference to FIG. 26. When a weft insertion failure takes place, the motors M, 1 and 18 are stopped in synchronism with one another, as indicated by curves $D_1$, $D_2$ and $D_3$, whereby the modified reed 6 is caused to stop at a position immediately before the beating position. After the loom has been stopped, the main control computer $C_0$ commands the feed-out motor 1 to perform a slow forward rotation by a predetermined amount $Q^+$ set through the input unit 31 as indicated by the curve $D_4$ shown in FIG. 26. At the same time, the computer $C_0$ commands the wind-up motor 18 to rotate slowly in the forward direction by a predetermined amount $R^+$ set through the input unit 31, as indicated by the curve $D_5$ shown in FIG. 26. In other words, prior to the slow reverse rotation of the loom motor M by a predetermined amount for the weft insertion failure eliminating processing, there are carried out the slow forward rotation of the feed-out motor 1 by the predetermined amount $Q^+$ and the slow forward rotation of the wind-up motor 18 by the predetermined amount $R^+$, respectively. Due to these slow forward rotations of the motors 1 and 18, the warps T are fed out by a predetermined amount or length $\rho$, while the cloth W is slowly wound up by the predetermined amount (length) $\rho$.

As a result of this, the loom motor M is rotated slowly in the reverse (backward) direction, as indicated by the curve $D_6$ in FIG. 26, to thereby revolve slowly the loom about one and a half rotation to the position where the maximum opening is formed between the warps T. At that time, the modified reed 6 moves from a stop position indicated by the solid line in FIG. 20 to the most retracted position indicated by the broken line to allow the warps T to form the maximum opening span therebetween. Thus, the failure suffering weft $Y_1$ on the cloth fell $W_1$ is released from the gripping action of the warps T, making it possible to perform the processing for remedying or eliminating the weft insertion failure. Incidentally, the feed-out motor 1 and the wind-up motor 18 are slowly rotated in the reverse direction in synchronism with the slow reverse rotation of the loom motor M, as indicated by curves $D_7$ and $D_8$.

After establishing the maximum opening, the feed-out motor 1 is slowly rotated in the reverse direction by a predetermined amount $Q^-$, as indicated by the curve $D_9$ in FIG. 26 with the wind-up motor 18 being slowly rotated in the reverse direction by a predetermined amount $R^-$ in synchronism with the wind-up motor 18 as indicated by a curve $D_{10}$ (in FIG. 26). As a result of this, the warps T are slowly drawn backwardly by a predeterrmiend amount (length) $\rho$ with the cloth W being slowly wound by the predetermined amount $\rho$, resulting in that the cloth fell $W_1$ returns to the normal position P.

In this manner, the main control $C_0$ is imparted with a first drive control function for driving a cloth fell displacing means constituted by the motors 1 and 18 to displace first the cloth fell $W_1$ by the predetermined amount or distance $\rho$ from the normal position P toward the cloth fell $W_1$ prior to the slow reverse rotation for effectuating the weft insertion failure eliminating processing and a second drive control function for restoring the cloth fell $W_1$ to the normal position at the end of the slow reverse rotation.

After the cloth fell $W_1$ has resumed the normal position P, the failure suffering weft $Y_1$ is removed, whereupon the one-shot insertion of fresh weft $Y_2$ and the weaving operation restart processing are executed, as in the case of the preceding embodiment.

As described previously in conjunction with the preceding embodiment, in the course of the slow reverse revolution of the loom about one and a half rotation for elimination of the weft insertion failure, the modified reed 6 moves from the stop position indicated by the solid line in FIG. 20 to the most retracted position indicated by the broken line while passing through the normal position (beating position) P. Accordingly, if the cloth fell $W_1$ lies at the beating position P, it will be beaten by the modified reed 6. However, since the cloth fell $W_1$ is retracted toward the cloth W from the beating position P prior to the slow reverse rotation of the loom for the weft insertion failure elimination processing, as described above, the cloth fell $W_1$ is never beaten by the modified reed 6. Consequently, wefts $Y_3$, $Y_4$ and others inserted prior to the weft $Y_1$ are protected against displacement in the direction thicknesswise of the cloth W, producing no twill pillow ascribable to the displacement of these wefts $Y_3$ and $Y_4$. Thus, according to the instant embodiment, generation of the twill pillow can be prevented more positively than in the case of the preceding embodiment.

The teachings of the present invention embodied in the fourth embodiment and the modification thereof may be applied to the weft inserting apparatus in which a plurality of weft end pass detectors 36 are disposed along a weft running or flying path as shown in FIG. 22. As further modified embodiments of the invention, it is possible to control the deenergization of the electromagnetic solenoid 26 with a predetermined timing instead of utilizing the weft unwinding detection signal or effect the one-shot relay energization/deenergization control in dependence on the weft unwinding detection signal instead of the timing control or allow the failure suffering weft $Y_1$ to be manually removed from the cloth fell $W_1$.

We claim:

1. An apparatus for preventing generation of a weaving bar in a room during suspension of weaving comprising:

means for displacing in the warp direction the position of the cloth fell of the fabric being woven; and means for controlling the amount of displacement of said cloth fell position by said cloth fell position displacing means;

said displacement control means including first control means for driving said cloth fell position displacing means so as to displace said cloth fell from a normal position in the uptake direction of the woven fabric by a predetermined amount before completion of a slow revolution of a crankshaft of the loom, and second control means for driving said cloth fell position displacing means to return said cloth fell to said normal position after completion of said slow revolution of the loom crankshaft.

2. An apparatus according to claim 1, wherein said cloth fell position displacing means includes at least one of a warp feed-out motor for driving a warp beam and a woven-fabric wind-up motor for driving a surface roller, and wherein said displacement control means includes a control computer connected to an input unit for inputting control information for the displacement of said cloth fell position.

3. An apparatus for preventing the generation of a weaving bar in a loom during suspension of weaving comprising:

means for changing the wrap tension;

means for presetting the warp tension desired during slow operation of said loom which slow operation occurs during suspension of the weaving operation, said presetting being selected to avoid the tendency of generation of the weaving bar due to the slow operation of the loom which occurs during suspension of the weaving operation; and means for controlling said warp tension changing means so that the warp tension preset by said means for presetting the warp tension becomes effective during the slow operation of said loom occurring during suspension of said weaving operation.

4. An apparatus according to claim 3, wherein said warp tension changing means includes a warp feed-out motor for driving a warp beam, said means for controlling said warp tension changing means includes a control computer, and said means for presetting the warp tension includes an input unit connected to said control computer.

5. An apparatus according to claim 4, wherein said control computer is supplied with inputs including a preset warp tension (F0) for normal operation of the loom set through said input unit, and a detected warp tension (F) detected by a warp tension detector of the loom.

6. An apparatus according to claim 4, wherein said control computer is coupled to means for supplying thereto through said input unit information of predetermined amounts of rotation of said feed-out motor corresponding to: a change in said warp tension upon occurrence of a weft insertion failure; restoration of said tension after elimination of said weft insertion failure; a change in said warp tension upon occurrence of a warp breakage; and the restoration of said tension upon restart of the weaving operation of the loom, respectively.

7. An apparatus according to claim 5, wherein said control computer is further supplied with inputs including a first warp tension ($F_1$) during slow reverse revolution of the loom effected upon occurrence of failure in weft insertion, and a second warp tension ($F_2$) during slow reverse revolution of the loom effected upon occurrence of warp breakage, said warp tensions ($F_1$, $F_2$) being set through said input unit, and wherein there are connected to said control computer a weft insertion failure detector and a warp breakage detector for supplying a weaving operation stop signal to said control computer upon occurrence of a weft insertion failure or a warp breakage, respectively.

8. An apparatus according to claim 7, in which said control computer is connected to said feed-out motor and includes command means, which when said weaving operation stop signal originates in said weft insertion failure detector, issues a command for slow forward rotation of said feed-out motor if said first warp tension ($F_1$) is lower than said preset warp tension ($F_0$) while commanding a slow reverse rotation of said feed-out motor if said first warp tension ($F_1$) is higher than said preset warp tension ($F_0$), to thereby effect the slow operation of said feed-out motor until said detected warp tension (F) coincides with said preset warp tension ($F_0$).

9. An apparatus according to claim 8, wherein the slow reverse rotation of said feed-out motor, effected after the loom crankshaft has been angularly displaced to a weaving operation start position through the slow reverse revolution, is performed by the control computer command means until said detected warp tension (F) becomes equal to said preset warp tension ($F_0$) for the normal weaving operation, the slow reverse rotation of said feed-out motor being stopped by said command means when said detected warp tension (F) becomes substantially equal to said preset warp tension ($F_0$).

10. An apparatus according to claim 3, wherein said warp tension changing means includes a tension lever for the woven fabric and drive means for swingingly displacing said tension lever, said means for controlling said warp tension changing means includes a control computer, and wherein said means for presetting the warp tension includes an input unit connected to said control computer.

11. An apparatus according to claim 10, in which said drive means includes an air cylinder connected to said tension lever, further comprising an electromagnetic valve for controlling an air supply to said air cylinder, and a regulator valve for adjusting the pressure of said air supply to said electromagnetic valve, and wherein energization/deenergization control of said electromagnetic valve and opening of said regulator valve are controlled by said control computer.

12. In a jet loom in which weft is ejected for insertion by a jet of fluid from a main weft inserting nozzle, said ejected weft being drawn by fluid jets from a plurality of auxiliary weft inserting nozzles, a one-shot weft inserting method following a weft insertion failure comprising the steps of:

after stopping weaving and removing a faulty weft operating all of said auxiliary weft inserting nozzles so that jets are produced simultaneously by all of said auxiliary weft inserting nozzles and subsequently inserting one weft under the action of a jet ejected from said main weft inserting nozzle before resuming weaving.

13. A one-shot weft inserting method according to claim 12, further comprising the steps of:

supplying a one-shot weft inserting starting reference signal to a second auxiliary control computer from a main control computer after a faulty weft has been removed;

electrically energizing electromagnetic valves fluidly associated with said plural auxiliary weft inserting nozzles under the control of said second auxiliary control computer in response to input of said reference signal to thereby allow said auxiliary nozzles to start ejection of fluid jets; and electrically energizing an electromagnetic valve fluidly associated with said main weft inserting nozzle after the lapse of a predetermined time from the time point at which said electromagnetic valves for said auxiliary weft inserting nozzles are electrically energized under the control of said second auxiliary control computer.

14. A one-shot weft inserting method according to claim 13, further comprising the steps of:

supplying a one-shot weft inserting starting reference signal to a first auxiliary control computer from said main control computer after a faulty weft has been removed; and electrically energizing a weft release solenoid provided in association with a weft length measuring device of the loom after the lapse of a predetermined time from the time point at which said electromagnetic valves for said auxiliary weft inserting nozzles are electrically energized, to thereby allow the weft to be drawn out from said weft length measuring device.

15. A one-shot weft inserting method according to claim 14, further comprising the step of:

deenergizing said solenoid for releasing said weft from said weft length measuring device through the control of said first auxiliary control computer to thereby prevent said weft from being delivered from said weft length measuring device, when a predetermined length of said weft as detected by a weft release detector provided in association with said weft length measuring device has attained a preset magnitude.

16. A one-shot weft inserting method according to claim 13, wherein said weft inserting main nozzle is supplied with weft ejecting air from a pressurized air supply tank dedicated to said weft inserting main nozzle, while said plurality of the auxiliary weft inserting nozzles are fluidly separated into a plurality of nozzle groups, wherein groups of said auxiliary weft inserting nozzles located on an upstream side relative to a weft running path are supplied with air from a common pressurized air supply tank having a predetermined capacity while a group of said auxiliary weft inserting nozzles located on a downstream side relative to said weft running path are supplied with air from another pressurized air supply tank having a predetermined capacity.

17. A one-shot weft inserting method according to claim 16, wherein electromagnetic valves for said upstream groups of the auxiliary weft inserting nozzles are successively deenergized in response to output signals of plural weft leading end passing detectors, respectively, which are disposed along said weft running path.

18. In a jet loom in which a weft is ejected for insertion by a jet of fluid from a main weft inserting nozzle, and thereafter drawn by fluid jets produced by a plurality of auxiliary weft inserting nozzles, a one-shot weft inserting method for replacing a faulty weft, comprising the steps of:

moving the cloth fell of a woven fabric from a normal position of the cloth fell in the direction of the uptake of the woven fabric prior to performing a slow reverse revolution of the loom for removing from the cloth fell the weft inserted immediately before suspension of weaving;

causing the cloth fell to return to said normal position after said slow reverse revolution of said loom;

removing from said cloth fell the weft inserted immediately before the weaving has been suspended;

operating all of said auxiliary weft inserting nozzles to thereby produce fluid jets simultaneously from said nozzles; and inserting one weft ejected from said weft inserting main nozzle prior to starting the weaving operation.

19. In a jet loom in which a weft is inserted under action of jets produced by a main weft inserting nozzle and a plurality of auxiliary nozzles, a method of preventing generation of a weaving bar in a cloth being woven by said loom during suspension of weaving, comprising the steps of:

stopping weaving operation;

removing the weft inserted immediately before said stopping of said weaving operation; and inserting one new weft to replace said removed weft under the action of the jet produced by said main weft inserting nozzle and the jets produced sequentially by said respective auxiliary weft inserting nozzles prior to restarting weaving operation.

20. In a jet loom in which a weft is inserted under action of jets produced by a main weft inserting nozzle and a plurality of auxiliary weft inserting nozzles, a method of preventing generation of a weaving bar in a cloth being woven by said loom during suspension of weaving comprising the steps of:

suspending the weaving operation;

moving the cloth fell of a woven cloth from the normal position of the cloth fell in the direction of the uptake of the woven cloth prior to performing a slow reverse revolution of the loom for removing from the cloth fell the weft inserted immediately before said suspending of the weaving operation;

causing the cloth fell to return to said normal position after said slow reverse revolution of said loom;

removing from the cloth fell the weft inserted immediately before the weaving was suspended; and inserting one new weft to replace said removed weft under the action of the jet produced by said main weft inserting nozzle and the jets produced sequentially by said plurality of auxiliary weft inserting nozzles prior to restarting weaving operation.

21. A method according to claim 20, wherein said loom includes a main computer and said step of inserting one new weft comprises causing said main computer to output a one-shot weft insertion starting reference signal to a second auxiliary control computer which responds to the input of said reference signal by energizing an electromagnetic valve for said main weft inserting nozzle to produce a fluid jet therefrom while causing, after the lapse of a predetermined time from the operation of said main weft inserting nozzle, sequential energization/deenergization of electromagnetic valves for said auxiliary weft inserting nozzles at a predetermined timing.

22. A method according to claim 21, further comprising the steps of:

electrically energizing a weft release solenoid provided in association with a weft length measuring device of said loom after the lapse of a predetermined time from the time point at which said electromagnetic valves for said auxiliary weft inserting nozzles are initially electrically energized, to thereby allow the weft to be drawn out from said weft length measuring device.

23. A method according to claim 22, further comprising the step of:

deenergizing said solenoid for releasing said weft from said weft length measuring device to thereby prevent said weft from being delivered from said weft length measuring device, when the length of said weft as detected by a weft release detector provided in association with said weft length measuring device has attained a preset value.

24. In a loom in which a weft is inserted under action of fluid jets produced by a main weft inserting nozzle and a plurality of auxiliary weft inserting nozzles, an apparatus for preventing generation of a weaving bar during suspension of weaving comprising:

means for removing a weft inserted immediately before stoppage of weaving to remove it from a cloth fell;

means for controlling energization/deenergization of a plurality of electromagnetic valves fluidly associated with said main weft inserting nozzle and said auxiliary weft inserting nozzles to supply fluid thereto;

means for displacing the position of the cloth fell of the woven fabric in the direction parallel to the warps; and means for controlling the amount of displacement of the cloth fell by said cloth fell position displacing means;

wherein said means for controlling said valves is imparted with a jet control function for causing said main weft inserting nozzle and said auxiliary weft inserting nozzles to produce the fluid jets in sequence to thereby insert one new weft for replacing said weft removed from the cloth fell by said weft removing means; and wherein said means for controlling the amount of displacement is imparted with a first control function for driving the cloth fell position displacing means to displace the cloth fell from the normal position thereof in the direction of the uptake of the woven fabric by a predetermined amount upon slow revolution of the loom, and a second control function for driving said cloth fell position displacing means to cause the cloth fell to resume said normal position after the slow revolution of the loom.

25. An apparatus according to claim 24, wherein said weft inserting main nozzle is supplied with weft ejecting air from a pressurized air supply tank dedicated to said weft inserting main nozzle, while said plurality of the auxiliary weft inserting nozzles are fluidly separated into a plurality of nozzle groups, wherein groups of said auxiliary weft inserting nozzles located on an upstream side relative to a weft running path are supplied with air from a common pressurized air supply tank having a predetermined capacity while a group of said auxiliary weft inserting nozzles located on a downstream side relative to said weft running path are supplied with air from another pressurized air supply tank having a predetermined capacity.

26. An apparatus according to claim 25, wherein said electromagnetic valves for said auxiliary weft inserting nozzles are successively deenergized in response to output signals of a plurality of weft leading end passing detectors, respectively, which are disposed along said weft running path.

27. An apparatus according to claim 24, further comprising a pressurized air supply tank connected to said main weft inserting nozzle, a breeze pipe fluidly associated with said main weft inserting nozzle and a pressure supply source, a check valve and a pressure regulator provided in said breeze pipe for adjusting air pressure supplied from said pressure supply source to be lower than the pressure in said pressurized air supply tank.

* * * * *

UNITED STATES PATENT AND TRADEMARK OFFICE

CERTIFICATE OF CORRECTION

PATENT NO. : 5,224,520

DATED : July 6, 1993

INVENTOR(S) : M. Shinbara et al

It is certified that error appears in the above-indentified patent and that said Letters Patent is hereby corrected as shown below:

Column 2, line 48, after "of" (second occurrence) insert --a--; after "thin" delete "a".

Column 14, line 49, correct spelling "denergization" to --deenergization--.

Column 21, line 57, "descripting" should read --description--.

Column 23, line 43, "$F_1$ and $F_1$" should read --$F_1$ and $F_i$--; line 45, "$V_1$; $V_1$" should read --$V_1$; $V_i$,--; line 47, "$F_1$" should read --$F_i$--.

Column 26, line 57, "room" should read --loom--.

Column 31, line 12, after "weaving" insert comma--,--.

Signed and Sealed this

Twenty-eighth Day of June, 1994

Bruce Lehman

*Attest:*

BRUCE LEHMAN

*Attesting Officer*

*Commissioner of Patents and Trademarks*